US007275554B2

(12) United States Patent
Mullholand

(10) Patent No.: US 7,275,554 B2
(45) Date of Patent: Oct. 2, 2007

(54) ASSISTIVE WALKING DEVICE

(76) Inventor: Larry Mullholand, P.O. Box 391, Santa Paula, CA (US) 93060

( * ) Notice: Subject to any disclaimer, the term of this patent is extended or adjusted under 35 U.S.C. 154(b) by 0 days.

(21) Appl. No.: 11/185,662

(22) Filed: Jul. 20, 2005

(65) Prior Publication Data

US 2006/0254631 A1 Nov. 16, 2006

Related U.S. Application Data

(63) Continuation-in-part of application No. 11/119,202, filed on Apr. 29, 2005.

(51) Int. Cl.
*A61H 3/04* (2006.01)

(52) U.S. Cl. ..... 135/67

(58) Field of Classification Search ..... 135/67, 135/66; 280/87.021, 87.03, 87.041, 87.05, 280/87.051; 297/5, 6; 482/66, 68
See application file for complete search history.

(56) References Cited

U.S. PATENT DOCUMENTS 2,459,066 A * 1/1949 Duke ..... 297/5
4,187,869 A * 2/1980 Marchetti ..... 135/67
4,239,248 A 12/1980 Ewers
4,342,465 A 8/1982 Stillings
5,476,432 A * 12/1995 Dickens ..... 135/67
5,618,055 A 4/1997 Mulholland
5,676,388 A 10/1997 Bertani
5,702,326 A * 12/1997 Renteria ..... 135/67
6,135,131 A * 10/2000 Downing ..... 135/67
6,343,802 B1 2/2002 Workman et al.
6,439,250 B1 8/2002 Balan
6,619,681 B2 9/2003 Gutierrez
6,733,018 B2 5/2004 Razon
6,742,523 B2 6/2004 Dubats

* cited by examiner

*Primary Examiner*—Tamara L. Graysay
(74) *Attorney, Agent, or Firm*—Charles J. Prescott

(57) ABSTRACT

An assistive walking rear entry device including a main frame, elongated upright body weight support members connected to each side portion of the main frame and two elongated leg members connected to each body support member one extending forwardly, the other extending rearwardly, each leg member including a rollable member attached to a distal end portion thereof. An elongated seat is attached to and supported on a lower portion of a centerpost, the centerpost being supported on the main frame. Rearwardly opening lateral torso supports are attached to the upper portion of the centerpost and make supporting contact with the thoracic area and for propelling the device during a walking gait. The seat is positioned against the perennial region to support the pelvis and to help propel the device on a "hands free" basis. The body weight support members are preferably multi-function for body weight support during a walking gait and preferably are tied together by a cross member to insure identical side-to-side displacement.

21 Claims, 23 Drawing Sheets

ASSISTIVE WALKING DEVICE

CROSS-REFERENCE TO RELATED APPLICATIONS

This application is a continuation-in-part of U.S. application Ser. No. 11/119,202 filed Apr. 29, 2005.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to adaptive aids for the handicapped and physically impaired, and more particularly to a weight-relieving walker which will assist in supporting the user's body in specific variable amounts during ambulation and without the need for being hand held for propulsion.

2. Description of Related Art

Adaptive aids of all sorts for the handicapped and physically impaired are to be found in an ever-growing market. One such area of growth is with respect to improvements in enhanced functionability of a conventional walker which is relied upon by the user through hand grasping of the side grips and either sliding or lifting forwardly or lateral movement of the walker by the user as each assisted step in ambulation is taken. However, arm strength is taxed and no body-supported rest is provided.

The following U.S. patents represent various improvements in the adaptive aids aimed at assisting in the ambulation of those who are physically impaired in walking:

U.S. Pat. No. 4,211,426 to Motloch
U.S. Pat. No. 4,239,248 to Ewers
U.S. Pat. No. 4,342,465 to Stillings
U.S. Pat. No. 5,152,730 to Hoffman
U.S. Pat. No. 5,255,697 to Grauer
U.S. Pat. No. 5,520,402 to Nestor, et al.
U.S. Pat. No. 5,676,388 to Bertani
U.S. Pat. No. 6,343,802 to Workman, et al.
U.S. Pat. No. 6,439,250 to Balan
U.S. Pat. No. 6,607,202 to Palmer
U.S. Pat. No. 6,619,681 to Gutierrez
U.S. Pat. No. 6,733,018 to Razon
U.S. Pat. No. 6,742,523 to Dubats
U.S. Pat. No. 6,832,770 to Wright-Ott, et al.

U.S. Pat. No. 4,239,248 to Ewers teaches a three-wheeled collapsible walker with spaced parallel bars disposed horizontally, two bars hingedly connected to the first bars and a third bar to which the second bars are hingedly attached. Stillings, in U.S. Pat. No. 4,342,465 discloses a safety walker with rigid framework surrounding the front, back and sides of a handicapped user.

An assisted walking apparatus is taught by Bertani in U.S. Pat. No. 5,676,388 which includes a frame having a pair of lower horizontal members between which the person may stand and a vertical member extending upwardly for disposition behind the person's back.

U.S. Pat. No. 6,343,802 to Workman, et al. discloses a support assistive device having a frame assembly, a vertical pelvis support connected thereto and a horizontal pelvis support element. Balan teaches a safety support device in U.S. Pat. No. 6,439,250 which includes a frame and pairs of forward and rearward rollered legs.

Gutierrez discloses a seating and walking wheelchair in U.S. Pat. No. 6,619,681 and Razon discloses a stand-up walker for supporting weight in U.S. Pat. No. 6,733,018. Dubats teaches an ambulator for assisting an individual in walking or standing in U.S. Pat. No. 6,742,523 and an orthotic walker is disclosed by Palmer in U.S. Pat. No. 6,607,202.

U.S. Pat. No. 5,152,730 to Hoffman teaches a walking aid comprising a wheeled frame which is freely moved by body contact without the use of the user's hands. A walking support apparatus is taught by Grauer in U.S. Pat. No. 5,255,697 and Wright-Ott, et al. discloses an ambulation aid which has a support structure for supporting the user's weight and is movable laterally with respect to the framework to accommodate sideways hip movement of the user's gait.

A portable mobile stand is taught by Nestor, et al. in U.S. Pat. No. 5,520,402 which uses a pair of side members with a vertical support member and a weight-relieving ambulator is disclosed by Motloch in U.S. Pat. No. 4,211,426.

The present invention is intended to further enhance the range of functions and the effectiveness of feature utilization for someone who is handicapped or in any way functionally impaired with respect to ambulatory muscle control or strength and which will be self-propelled by body movement as the user ambulates without the need for hand grasping to slide or lift the device during each stride taken during a walking gait. Moreover, the user is free to move and reach forwardly, laterally and rearwardly without substantial obstruction and is further provided with a seat, which provides the user with variable weight bearing as the torso moves up and down during each step taken. Convenient collapsibility is also provided. In certain circumstances where an imbalance of displacement occurs side-to-side based upon uneven body weight distribution, an additional transverse tie bar rigidly connecting the lower tubular portions of each of the body weight support members.

BRIEF SUMMARY OF THE INVENTION

This invention is directed to an assistive walking rear entry device including a main frame, elongated upright body weight support members connected to each rear portion of the main frame and two elongated leg members connected to each body support member extending forwardly, the other extending rearwardly, each leg member including a rollable member attached to a distal end portion thereof. An elongated seat attached to and supported on a lower portion of a centerpost, the centerpost supported on the main frame at the mid portion thereof. Rearwardly opening lateral torso supports attached to the thoracic area for propelling contact therewith during a walking gait. The seat positions against the perennial region to support the pelvis. The body weight support members are preferably multi-function for partial body weight support during a walking gait and during entrance and egress.

It is therefore an object of this invention to provide an improved assistive walking device for individuals of insufficient leg strength to stand or walk independently.

Yet another object of this invention is to provide an assistive walking device which is easily foldable into a compact carrying and storage size.

Yet another object of this invention is to provide an assistive walking device which will automatically support varying amounts of body weight of an individual with weak leg strength during a walking gait.

Still another object of this invention is to provide an assistive walking device for the physically impaired who are not fully capable of standing and walking independently and which is adjustably versatile to accommodate a very broad range of user height, size and strength requirements.

Another object of this invention is to provide an assistive walking device providing rear loading and egress features for the user while maintaining full front and rear clearance for normal upper torso and arm movement.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
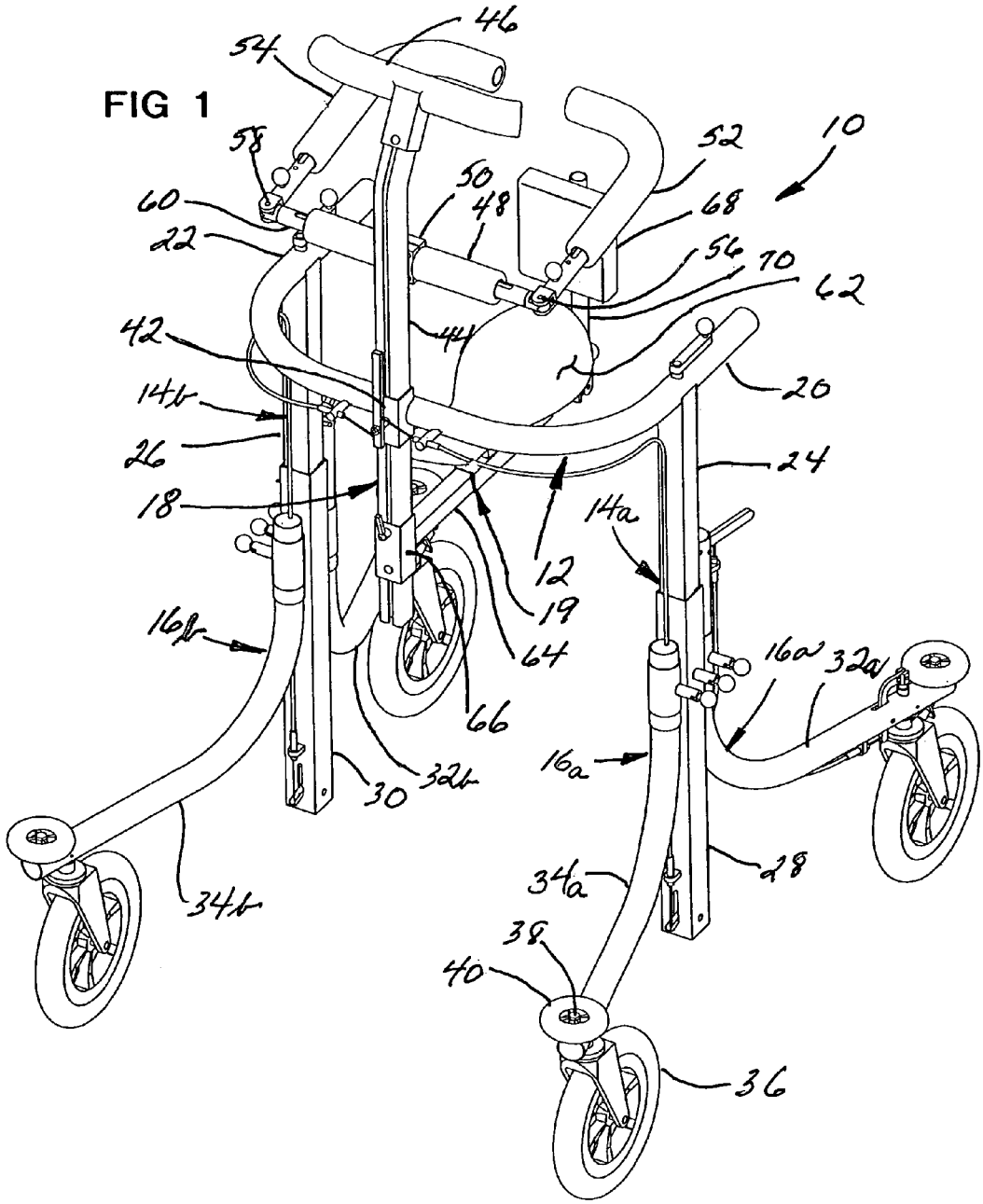
FIG. 1 is a front perspective view of the invention.
Figure 2:
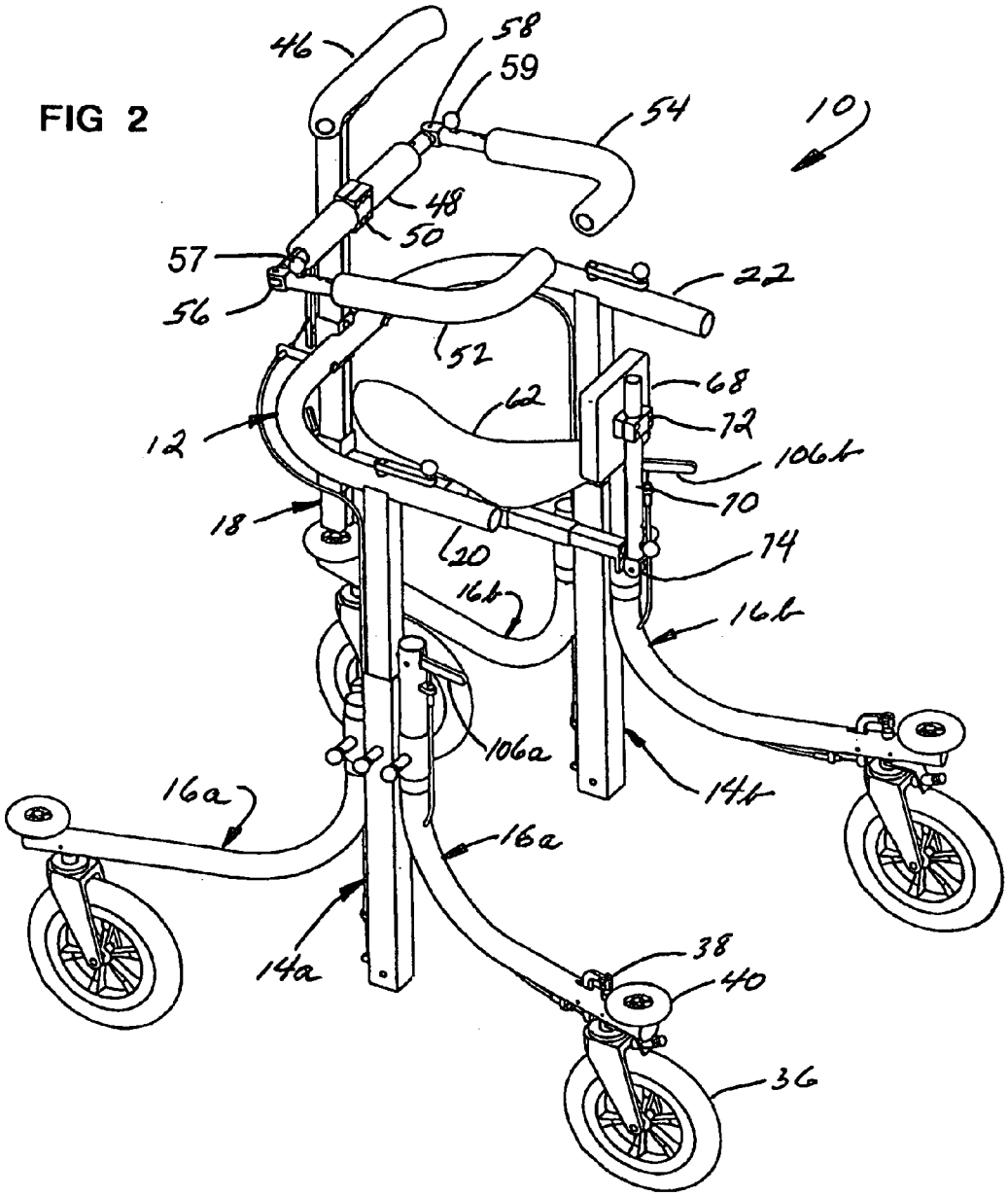
FIG. 2 is a rear perspective view of the invention.

Referring now to the drawings, the invention is there shown generally at numeral 10 and, in this preferred embodiment, includes a generally U-shaped main frame 12, spaced apart upright body weight support members 14*a* (right side) and 14*b* (left side), longitudinally extending leg assemblies 16*a* and 16*b*, a centerpost 18 and a seat assembly 19. The generally upright body weight supports 14*a* and 14*b* each have upper tubular members 24 and 26, respectively which are connected at their upper ends to a mid portion of the corresponding side portions 20 and 22 of main frame 12. The centerpost 18 includes an upright channel member 44 having a cross section which is shown in FIG. 3A having fore and aft opposing channels 45 and 47 and which is slidably lockable within a tubular support channel 42 rigidly attached to a mid point of the main frame 12.

Figure 6:
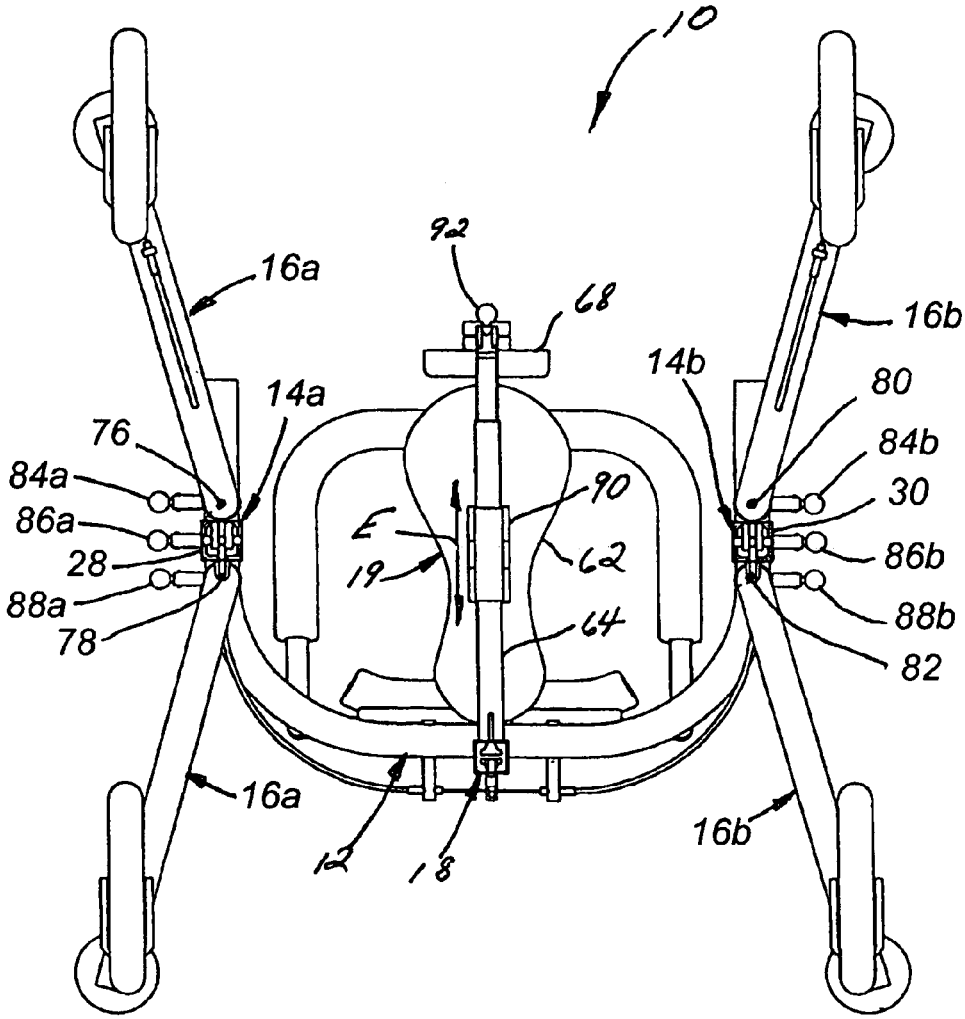
FIG. 6 is a bottom plan view of the invention.

The seat assembly 19 includes a uniquely configured seat 62 better adapted to a user anatomy and movement as described in more detail herebelow which is connected for fore and aft adjustable securement in the direction of arrow E as best seen in FIG. 6 to a longitudinally extending tubular member 64 rigidly connected at a forwardly end thereof to a tubular channel member 66. The tubular member 66 is, in turn, slidable engagable within the channel section shown in FIG. 3A of channel member 44 and lockable at a desired height position in the direction of B by lock handle 65.

Four leg assemblies 16*a* (right side) and 16*b* (left side) are provided and include arcuately shaped legs 32*a* and 32*b* and 34*a* and 34*b*, each of which has a generally upright portion lockably engageable for vertical support and from axial rotation into upright support tubes rigidly attached to the front and rear surfaces of the lower tubular members 28 and 30 of each body weight support 14*a* and 14*b*, respectively. By this arrangement, each of the leg assemblies 16*a* and 16*b* is held for selected releasable rotation into a storage position (described herebelow) about axes 76, 78, 80, and 82, respectively shown in FIGS. 3 and 6.

Disposed at or adjacent to a lower end of each of the legs 32*a* and 32*b* and 34*a* and 34*b* are rollable castered wheels 36 supported for rotation about a vertical axis 38 and having a donut shaped horizontally disposed bumper 40 which also may rotate to reduce scuffing and ease of passing past close upright surfaces. Additionally, the rear casters 36 which are attached to each of the rear legs 32*a* and 32*b* are lockable in a fore and aft non-steerable position by pivoted lock member 110 acting into a slot 112 of the extended mounting shaft of the caster 36. A release lever 106*a* and 106*b* and connecting cable 108 facilitate the lockable and released engagement therebetween.

Figure 5:
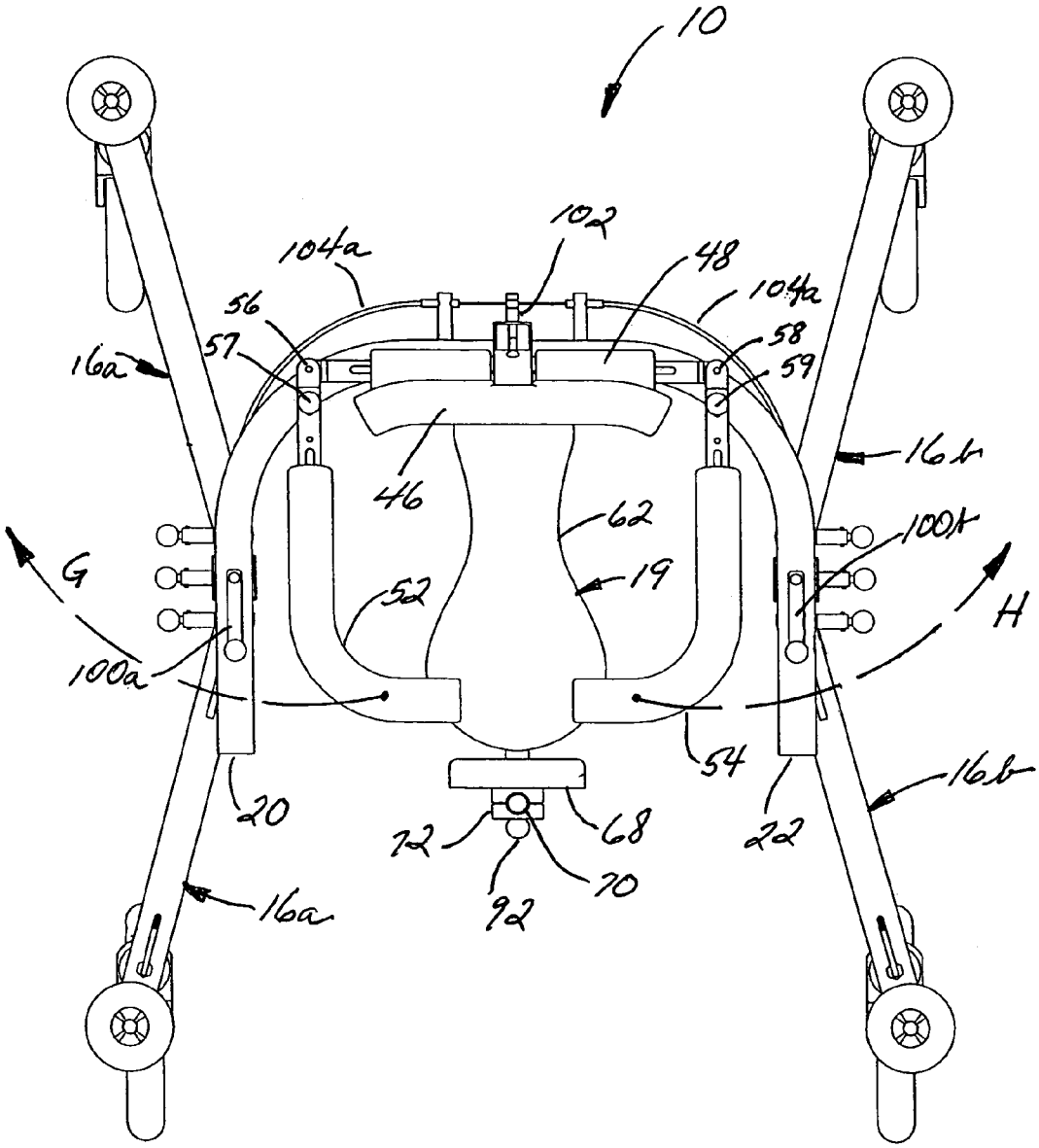
FIG. 5 is a top plan view of the invention.

The mid section of the torso of a user is supported forwardly against a laterally extending padded torso bar 48 connected centrally thereof to a mounting block 50 for vertical lockable adjustment in the direction of arrow T on channel member 44. Two padded L-shaped torso support arms 52 and 54 are pivotally connected at 56 and 58 to either end of adjustable extensions 60 of the torso bar 48 such that, in the closed configuration shown, the torso of the user is substantially held from unbalanced or excessive movement both laterally and rearwardly when positioned within the device 10. Upper torso bar 46, connected to the upper end of channel member 44 and positioned above torso bar 48, provides additional torso support and stability. As best seen in FIG. 5, by releasing each of the locking pins 57 and 59 individually, these torso support arms 52 and 54, which are also padded for comfort, will swing outwardly in the direction of arrows G and H to provide convenient access or entrance by the user into the device from rearwardly thereof for use. Thereafter, these torso support arms 52 and 54 are pivotable in the opposite direction of arrows G and H back into the closed and locked position for torso support. Additionally, adjustment for body size is accomplished in the direction of arrow D and, again, height wise in the direction of arrow T as seen in FIG. 3 as required.

Preferably disposed at a rearward end of the horizontal seat support member 64 is a padded coccyx support 68 which is held on upright pivotable shaft 70 within a split support block 72 for adjustability in the direction of arrow C. By fore and aft movement of arm 75 which controls positioning of an internal wedge (not shown), adjustment fore and aft in the direction of arrow S of the coccyx support 68 is achieved. To facilitate entrance and egress by the user, the coccyx support 68 is pivotally movable about the lower pivot point 74 by the release of spring loaded pin 92 in the direction of arrow F shown in FIG. 9.

Figure 3:
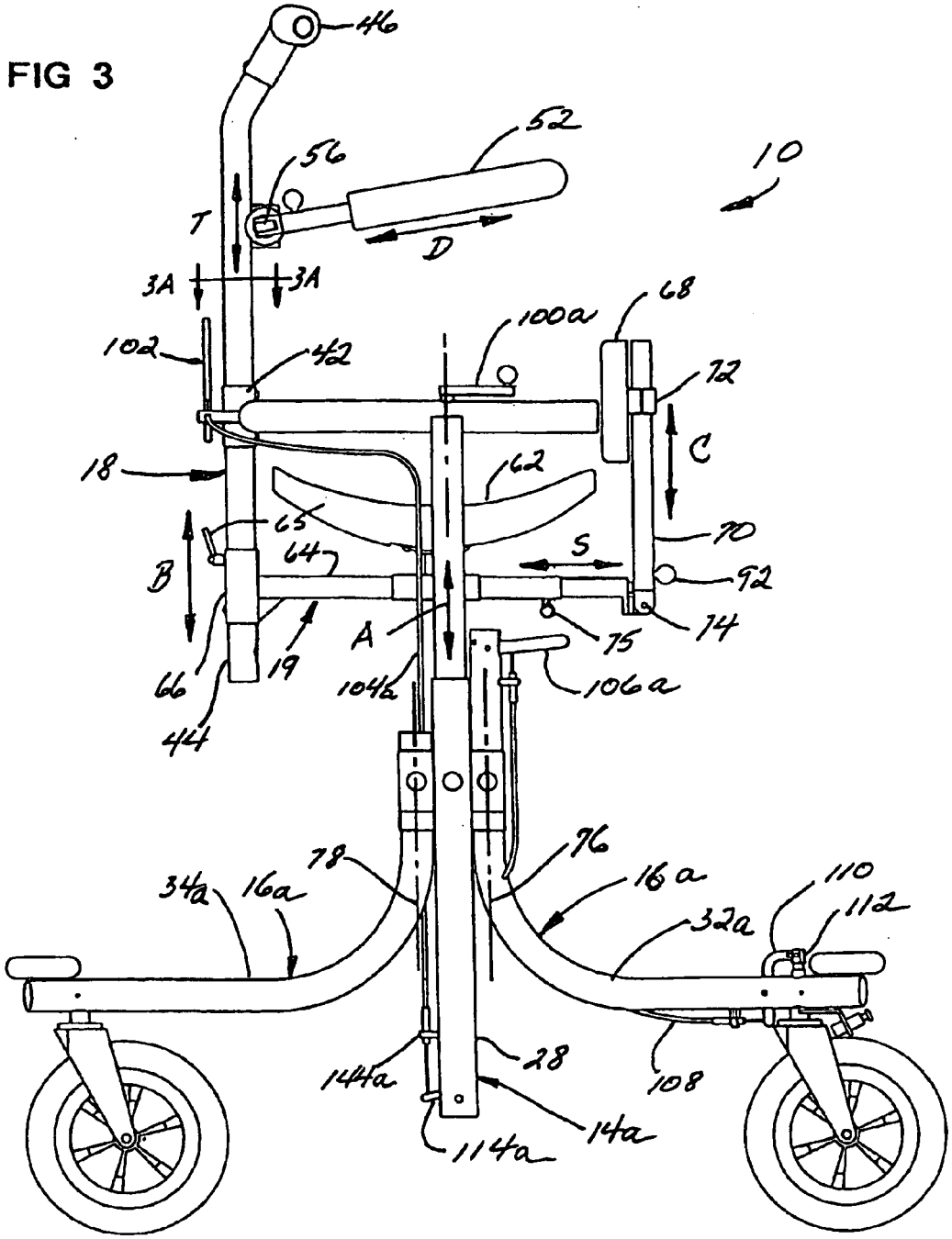
FIG. 3 is a side elevation view of the invention depicting adjustment features associated therewith.
Figure 3A:
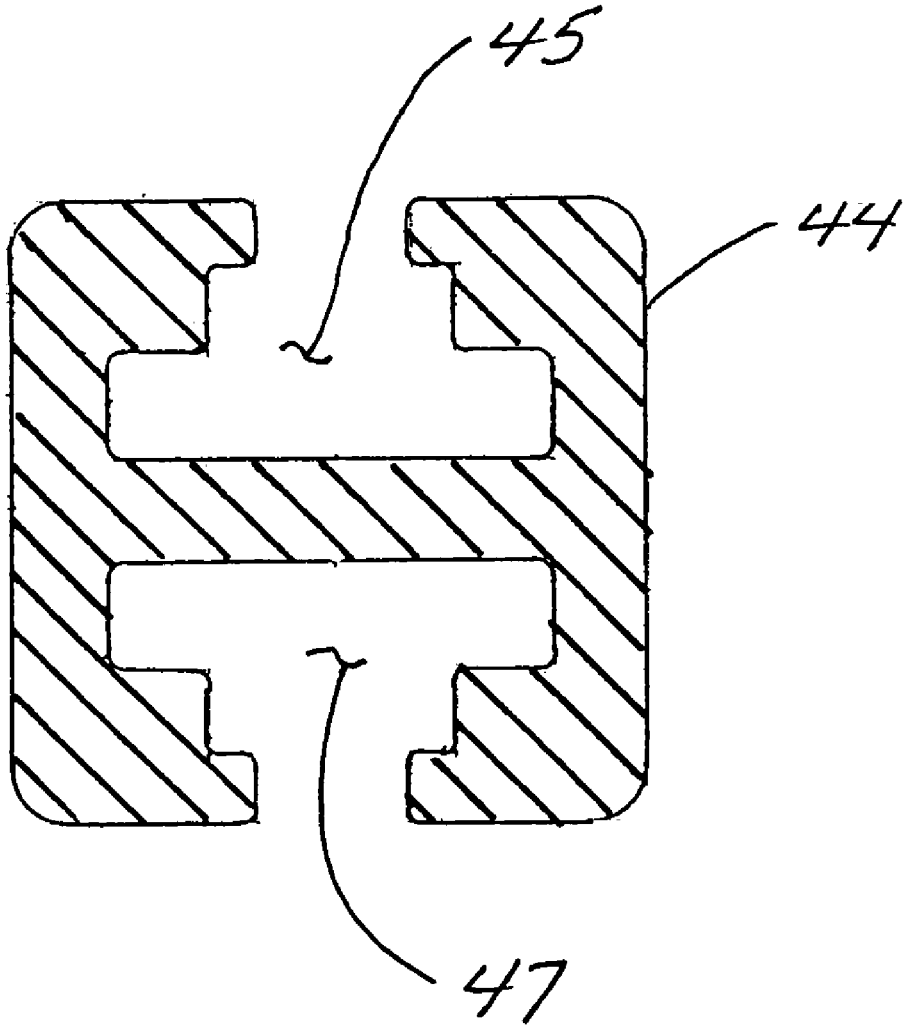
FIG. 3A is a section view in the direction of arrows 3A—3A in FIG. 3.
Figure 4:
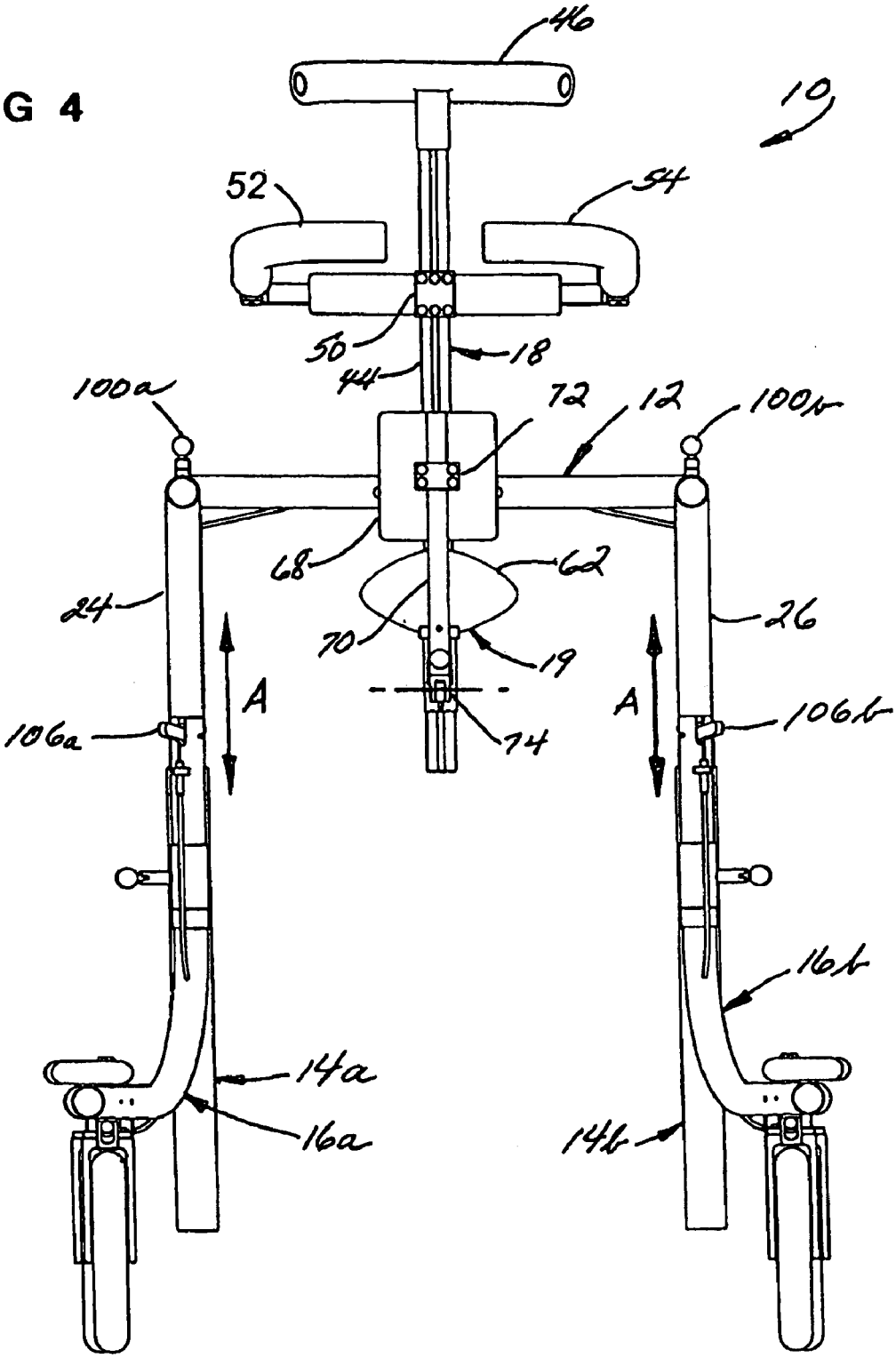
FIG. 4 is a rear elevation view of the invention.
Figure 9:
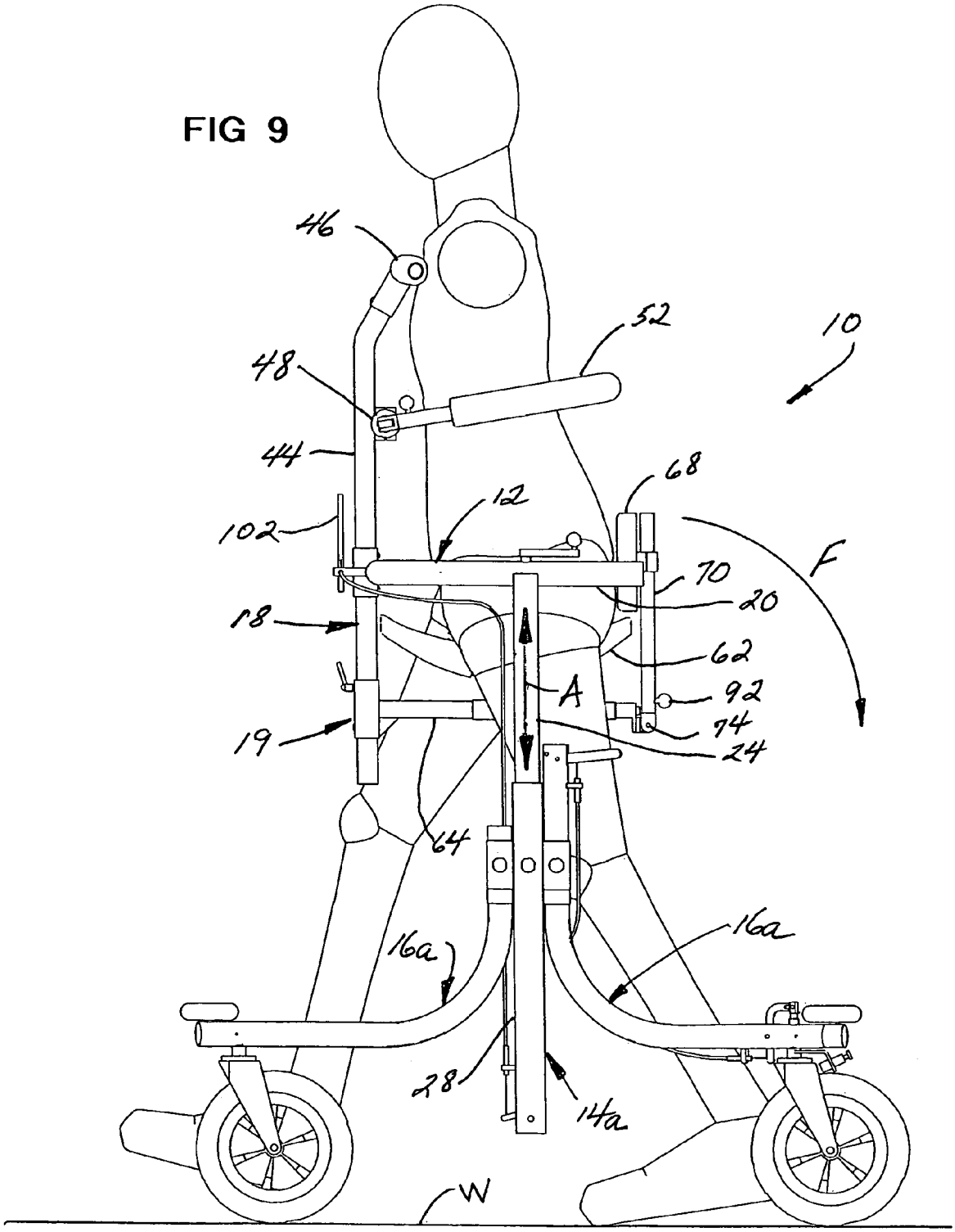
FIG. 9 is a side elevation view of FIG. 7.
Figure 10:
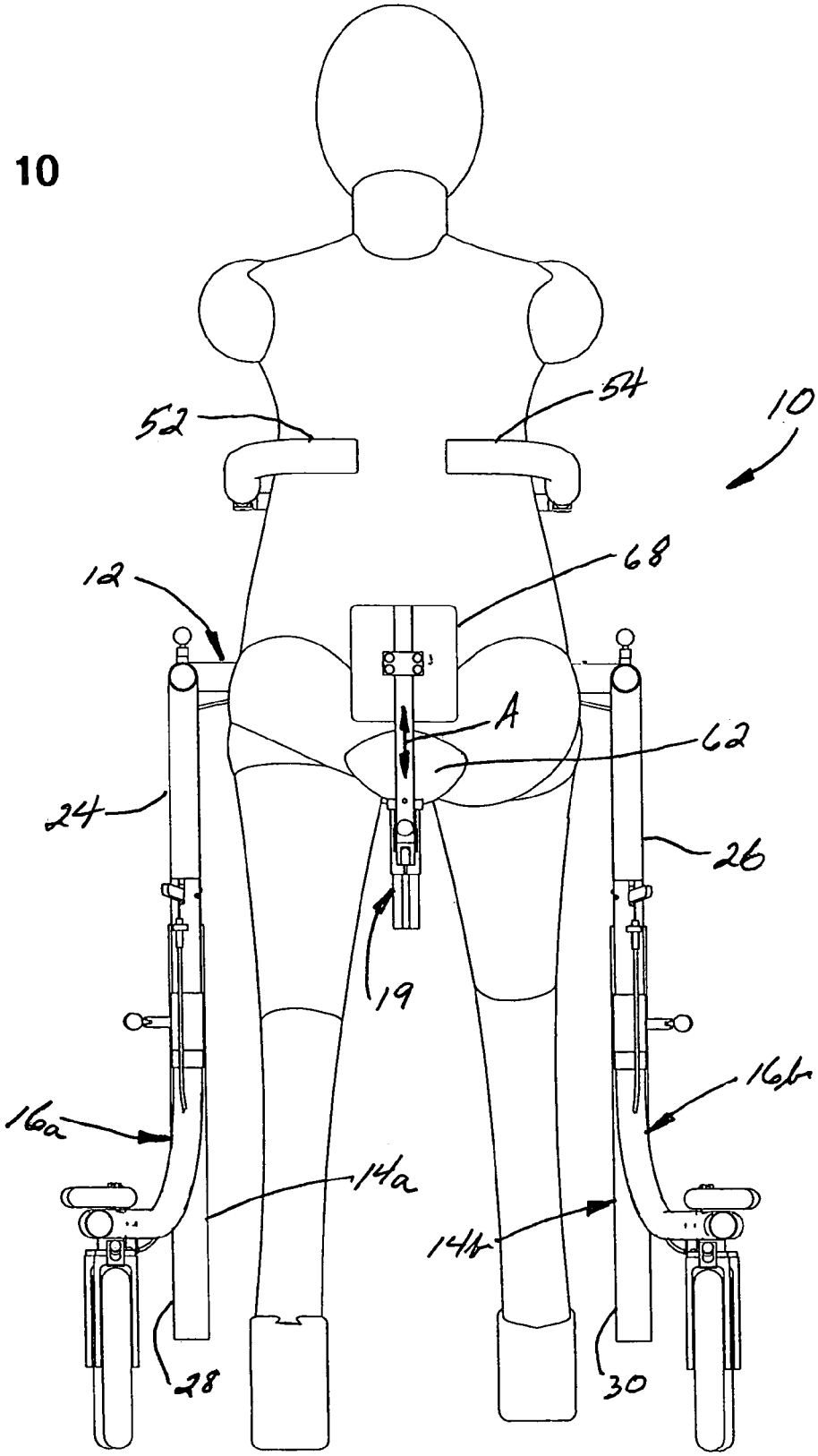
FIG. 10 is a rear elevation view of FIG. 7.
Figure 11:
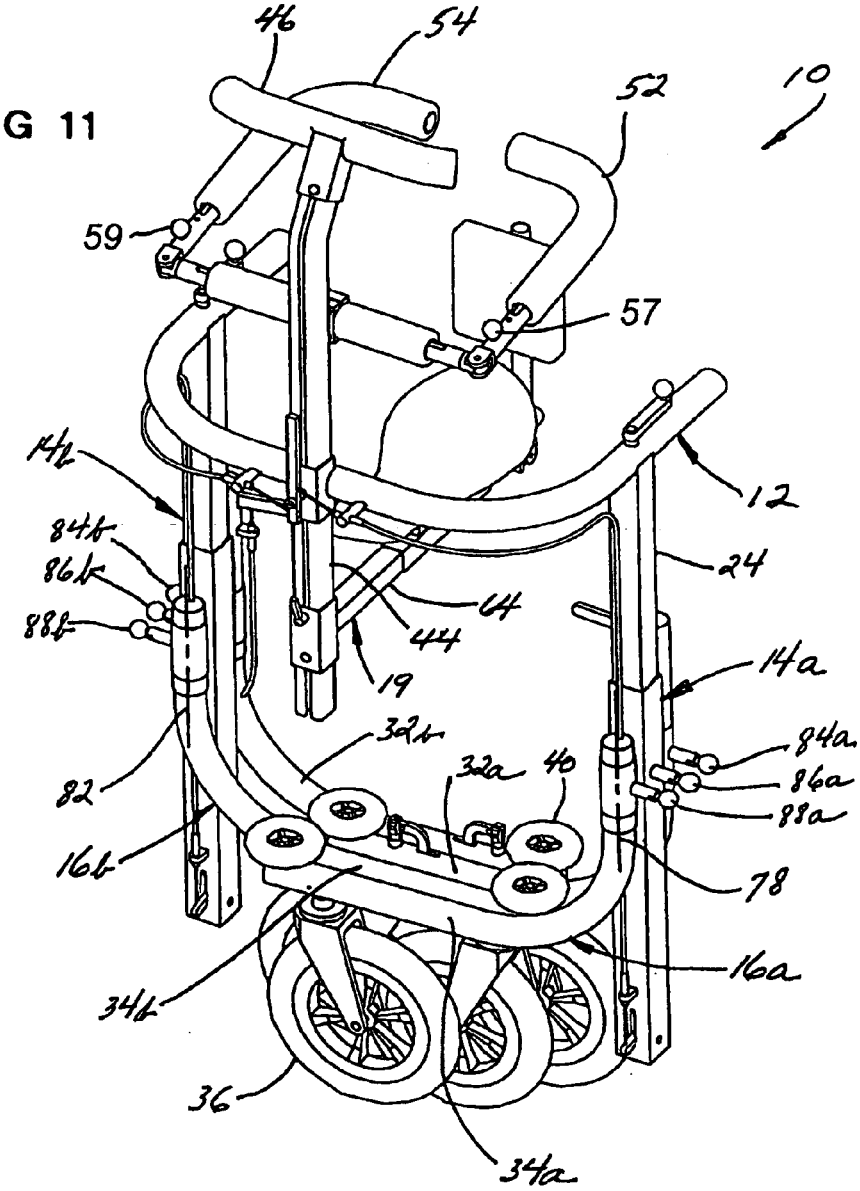
FIG. 11 is a front perspective view of the invention in the collapsed or folded configuration.
Figure 12:
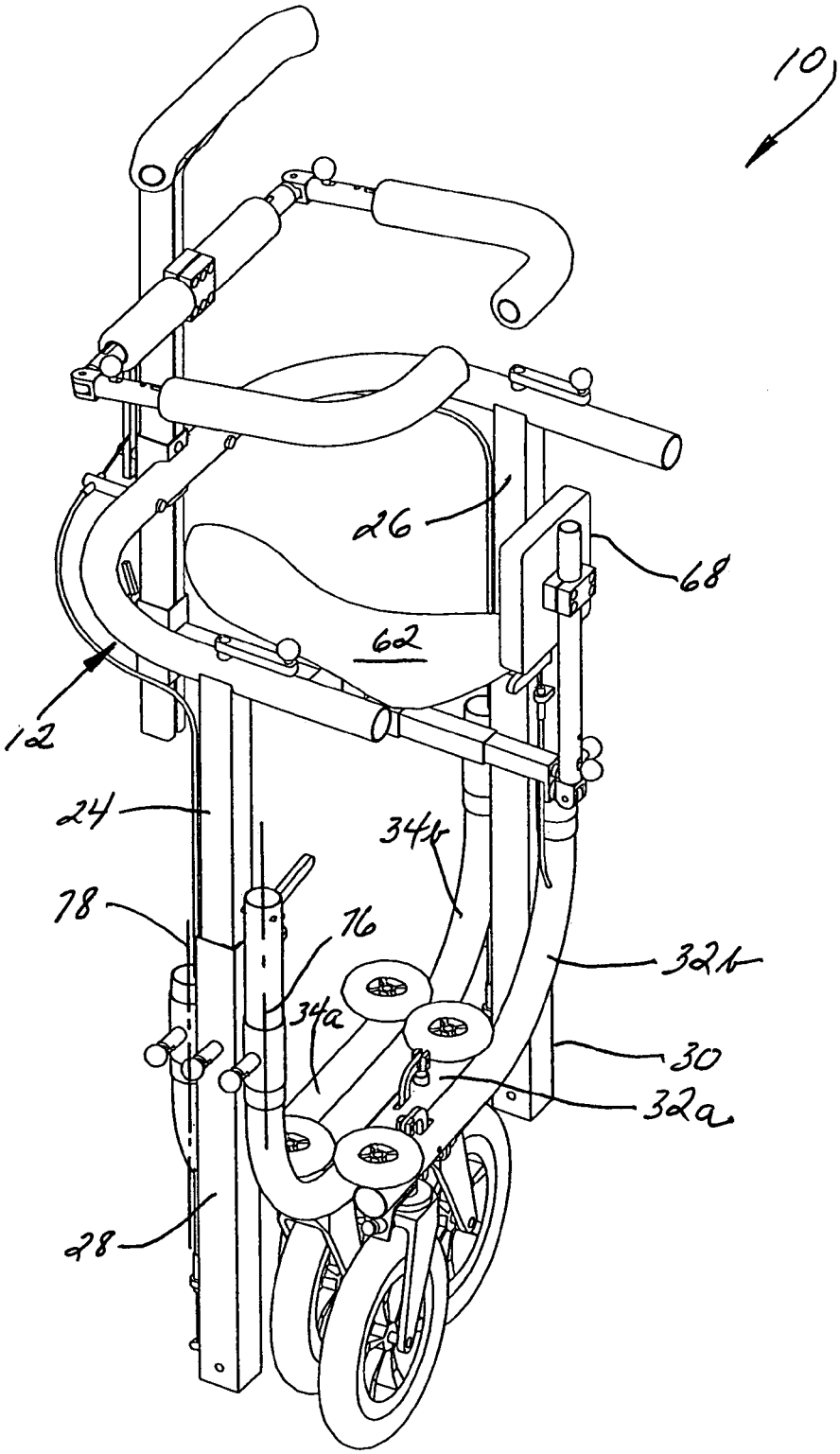
FIG. 12 is a rear perspective view of FIG. 11.
Figure 13:
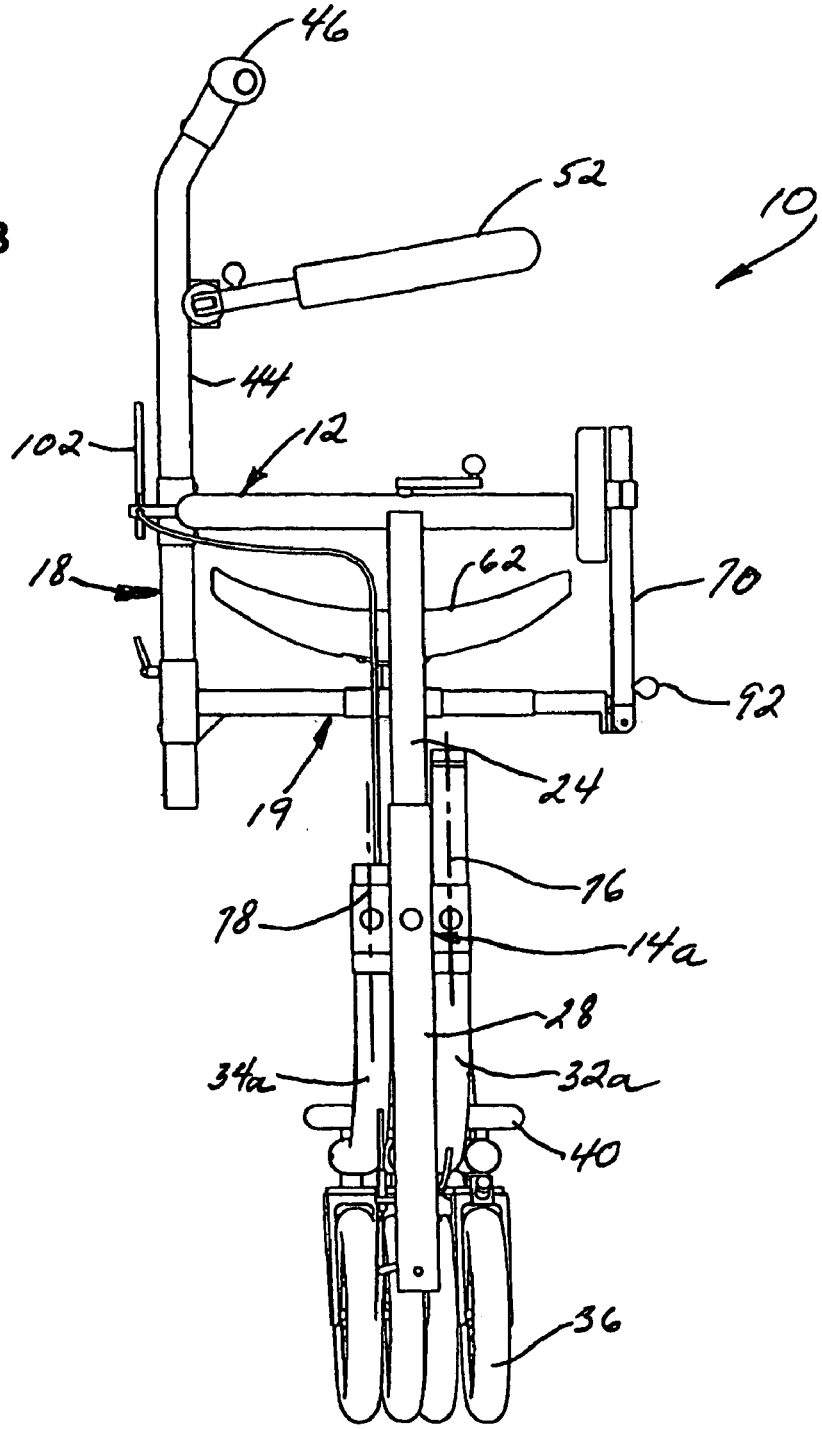
FIG. 13 is a side elevation view of FIG. 11.
Figure 14:
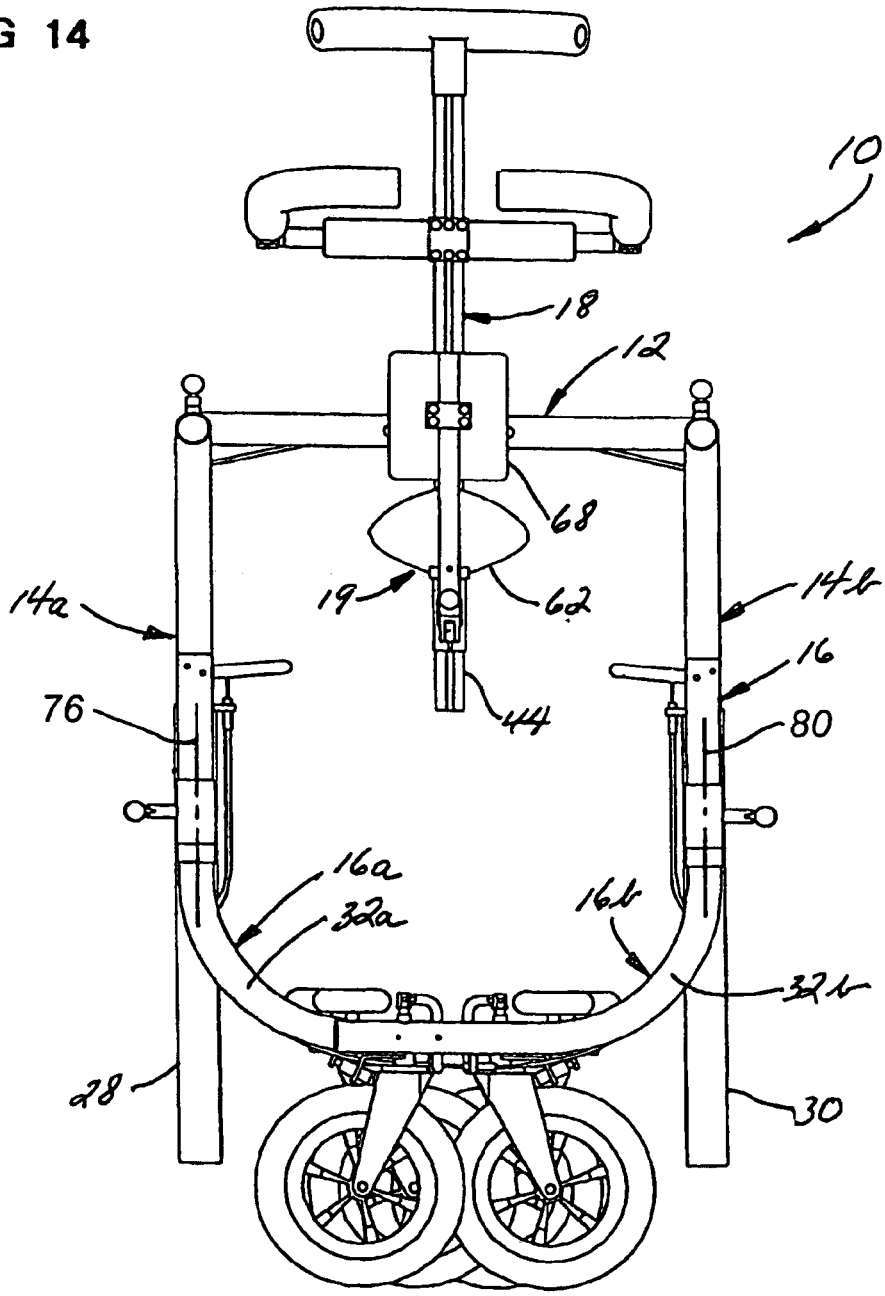
FIG. 14 is a rear elevation view of FIG. 11.
Figure 15:
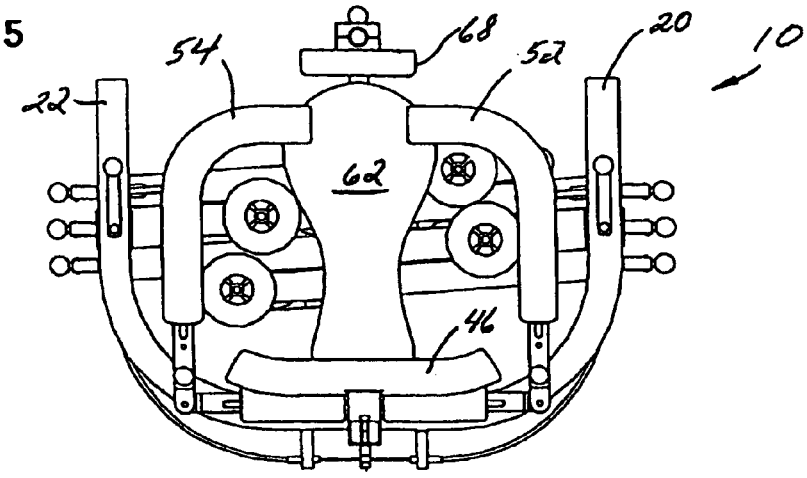
FIG. 15 is a top plan view of FIG. 11.

The height of the seat 62 is initially positionable above a support surface W in the direction of arrow B as seen in FIG. 3 such that its generally hourglass shape as best seen in FIG. 6 is positioned against the thighs of the user, and further, that the arcuate concave top surface of the seat 62, as best seen in FIG. 3 and partially in FIGS. 9 and 10 is comfortably positioned against the perineal area of the user. By this arrangement, during each stride taken during a normal walking gait, as the body of the user slightly moves upward and downwardly, the body weight is carried on the seat 62 and distributed and interactive with respect to the body weight supports 14*a* and 14*b* through main frame 12 as will be described herebelow.

Collapsibility

Figure 16:
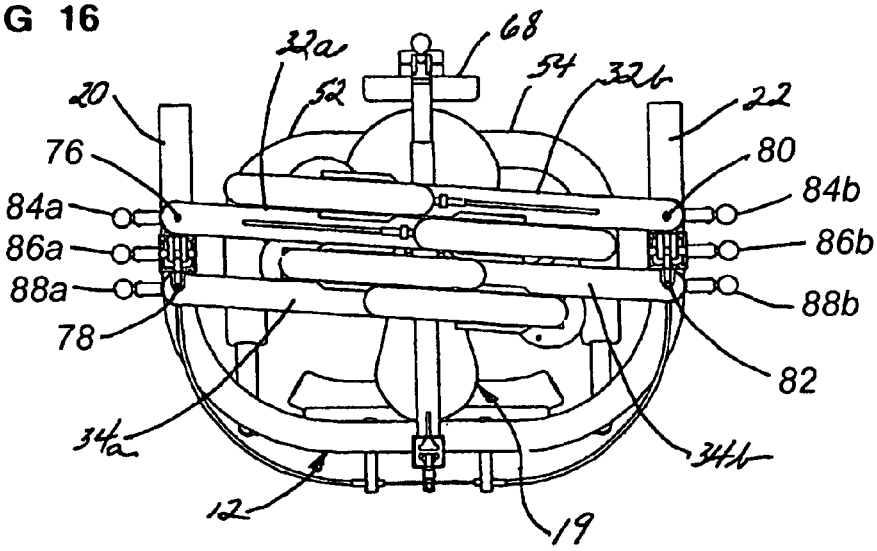
FIG. 16 is a bottom plan view of FIG. 11.

Referring now to FIGS. 11 to 16 specifically, the collapsibility of the invention 10 into a compact easily carryable and storable configuration is there shown. Each of the leg assemblies 16*a* and 16*b* is released by corresponding spring biased pins 84*a* and 84*b* and 88*a* and 88*b* which facilitates closing pivotal movement about the pivotal axes 76, 78, 80 and 82 as best seen in FIG. 16. By releasing pins 86*a* and 86*b* in spring slots 126 seen in FIG. 17, main frame 12 will collapse downwardly to reduce overall height. These leg assemblies 16*a* and 16*b* thus fold onto themselves in an alternate or stacked arrangement in a generally transverse orientation.

Height Adaptability

Figure 17:
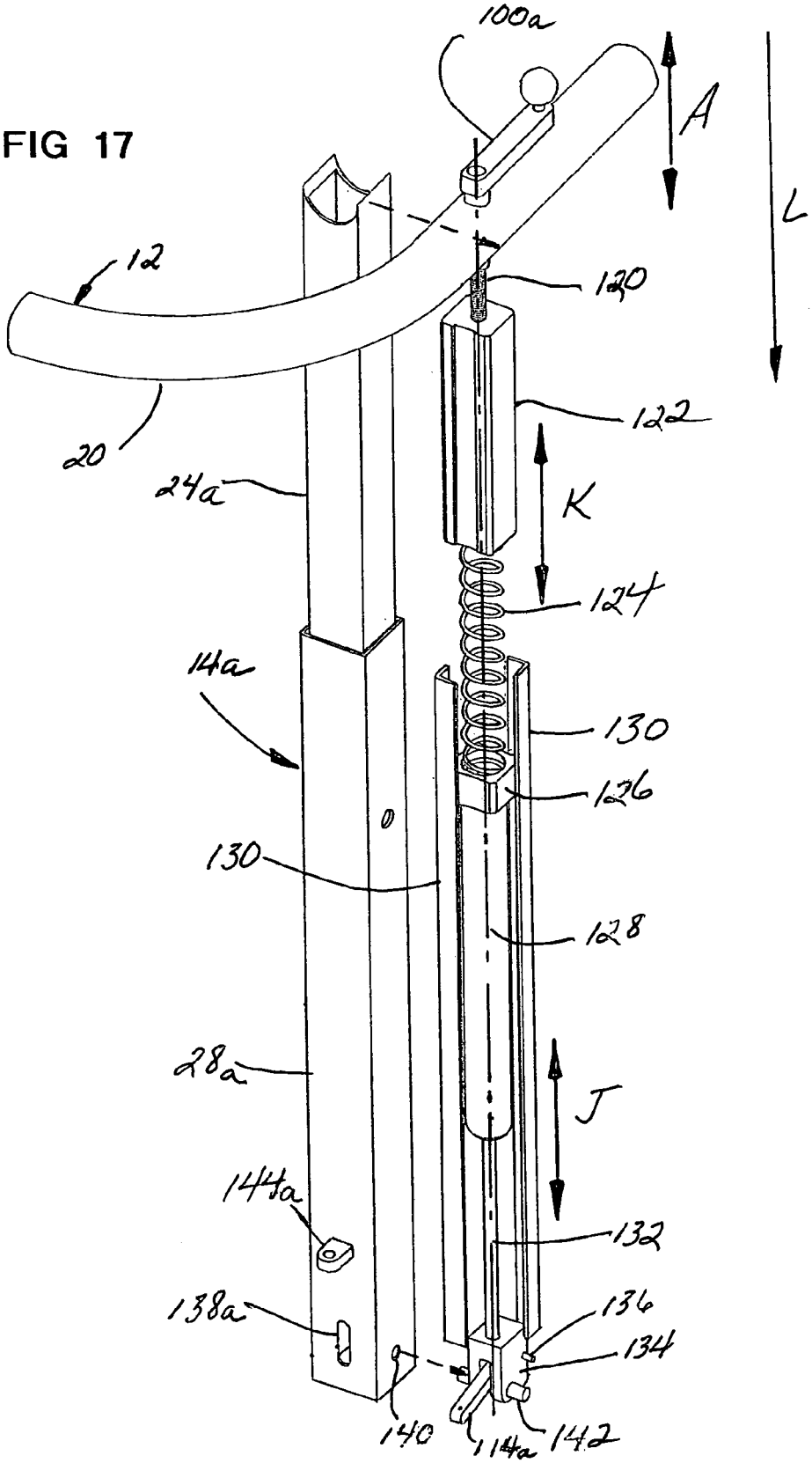
FIG. 17 is an enlarged front perspective view of a portion of the main frame and the body weight support member.
Figure 18:
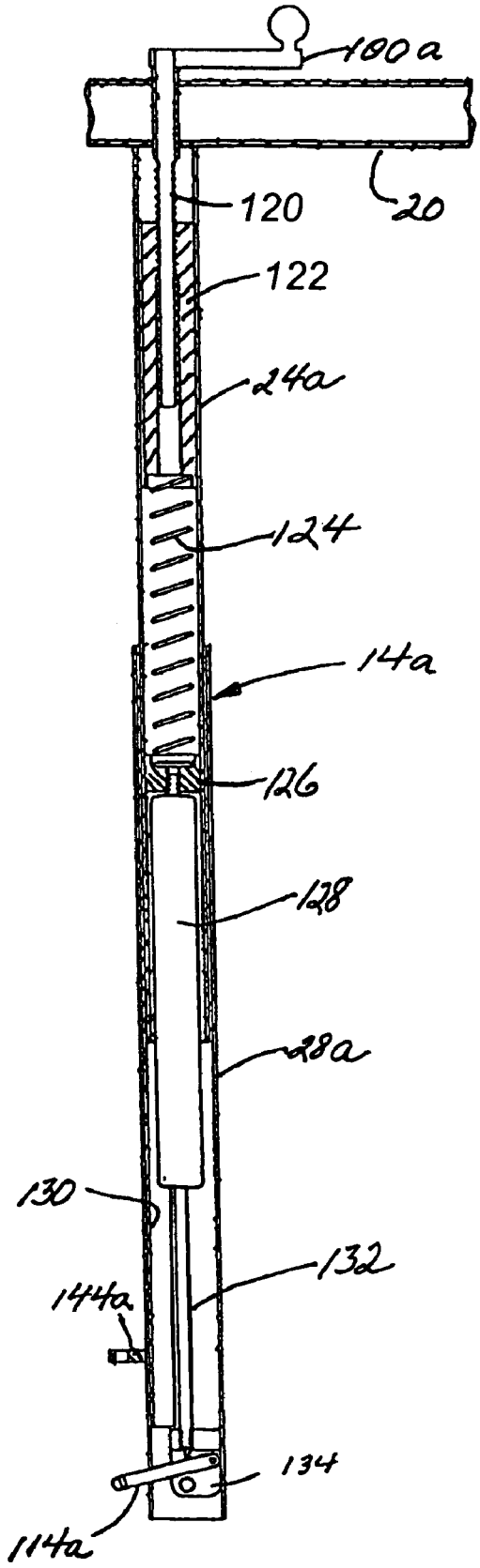
FIG. 18 is a side elevation section view of FIG. 17.
Figure 19:
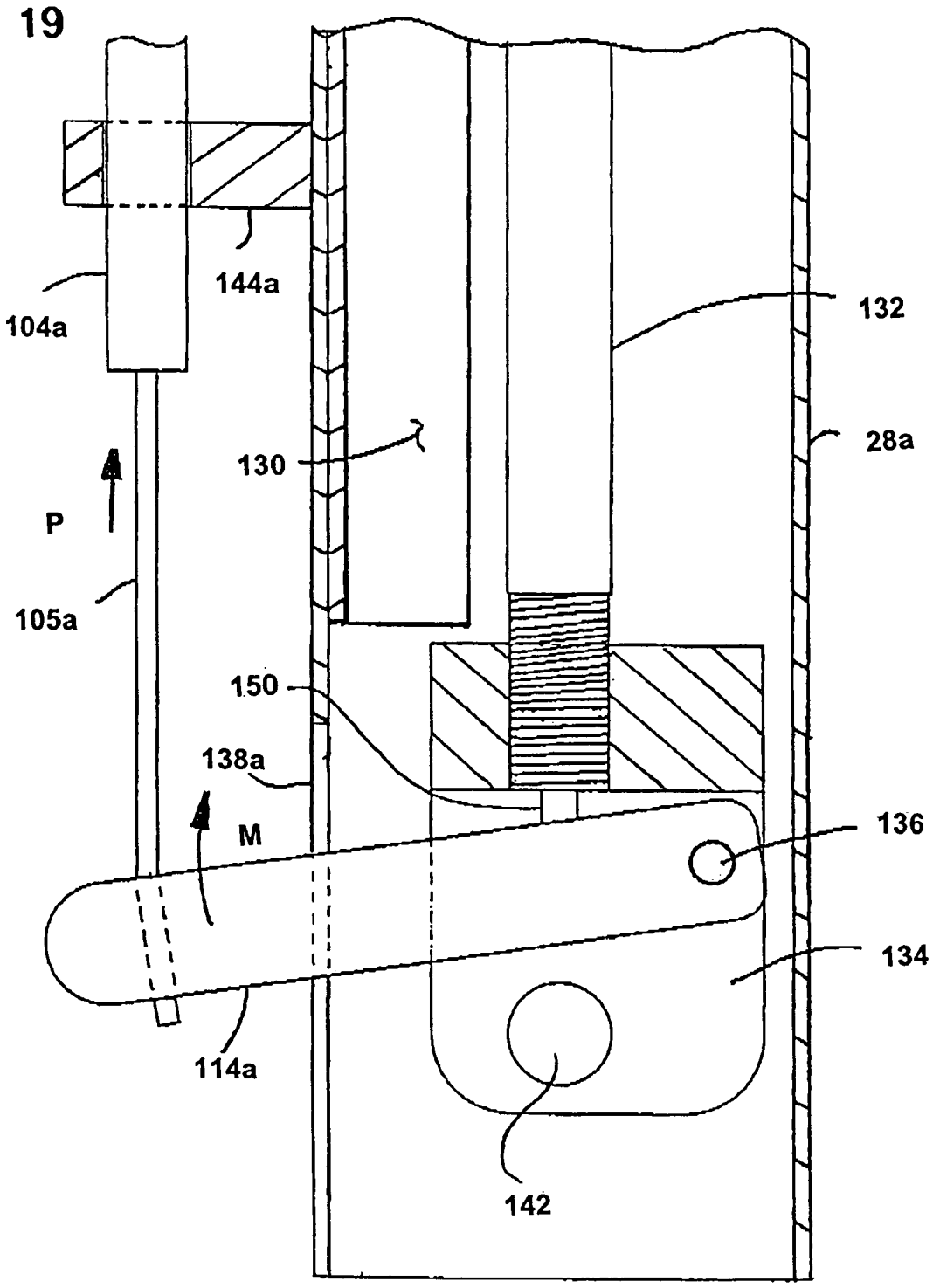
FIG. 19 is a further enlarged view of the lower portion of FIG. 18.
Figure 20:
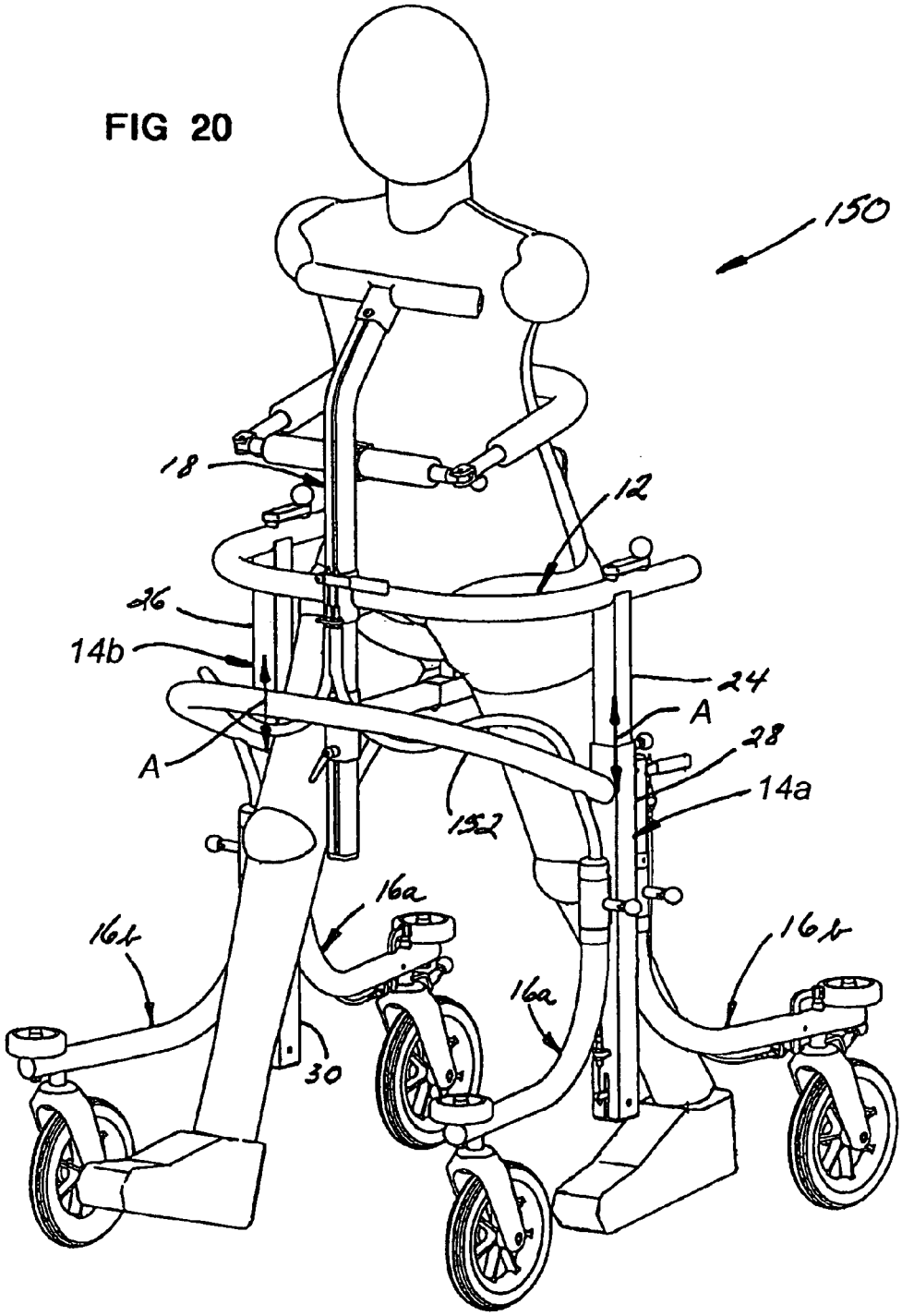
FIG. 20 is a front perspective view of an alternate and preferred embodiment of the invention depicting a humanoid supported thereby during a normal walking gait.
Figure 21:
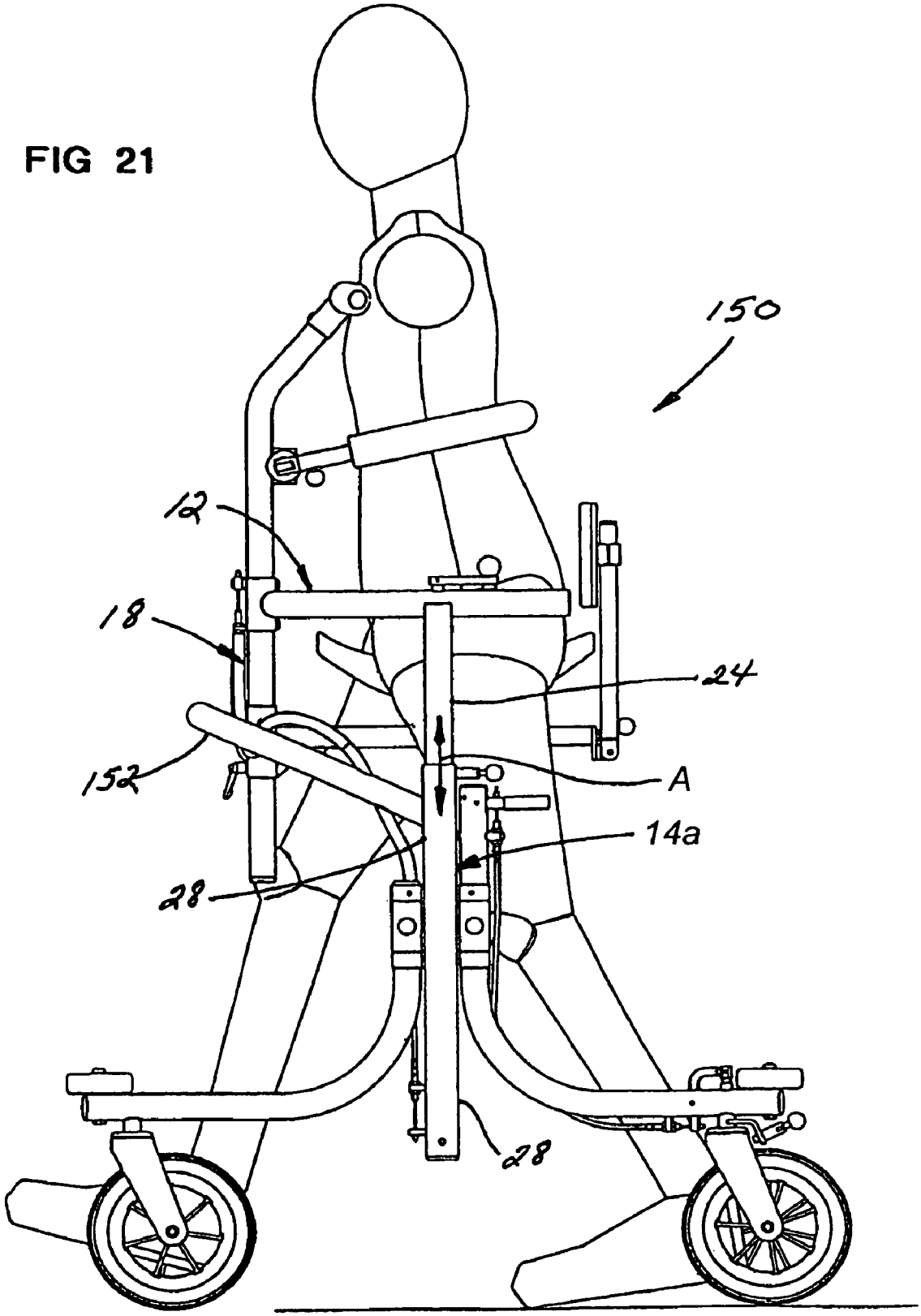
FIG. 21 is a side elevation view of FIG. 20.
Figure 22:
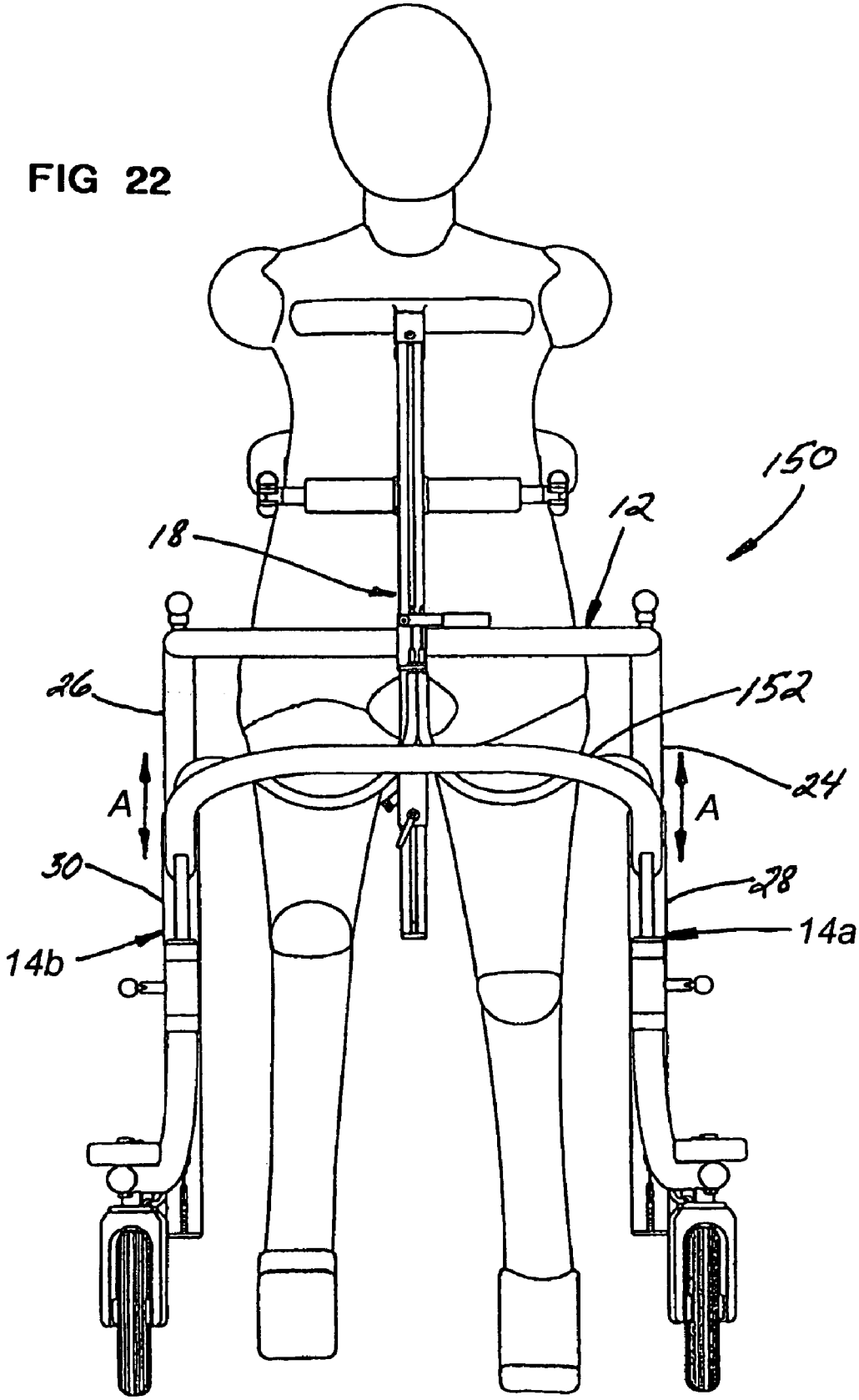
FIG. 22 is a front elevation view of FIG. 20.
Figure 23:
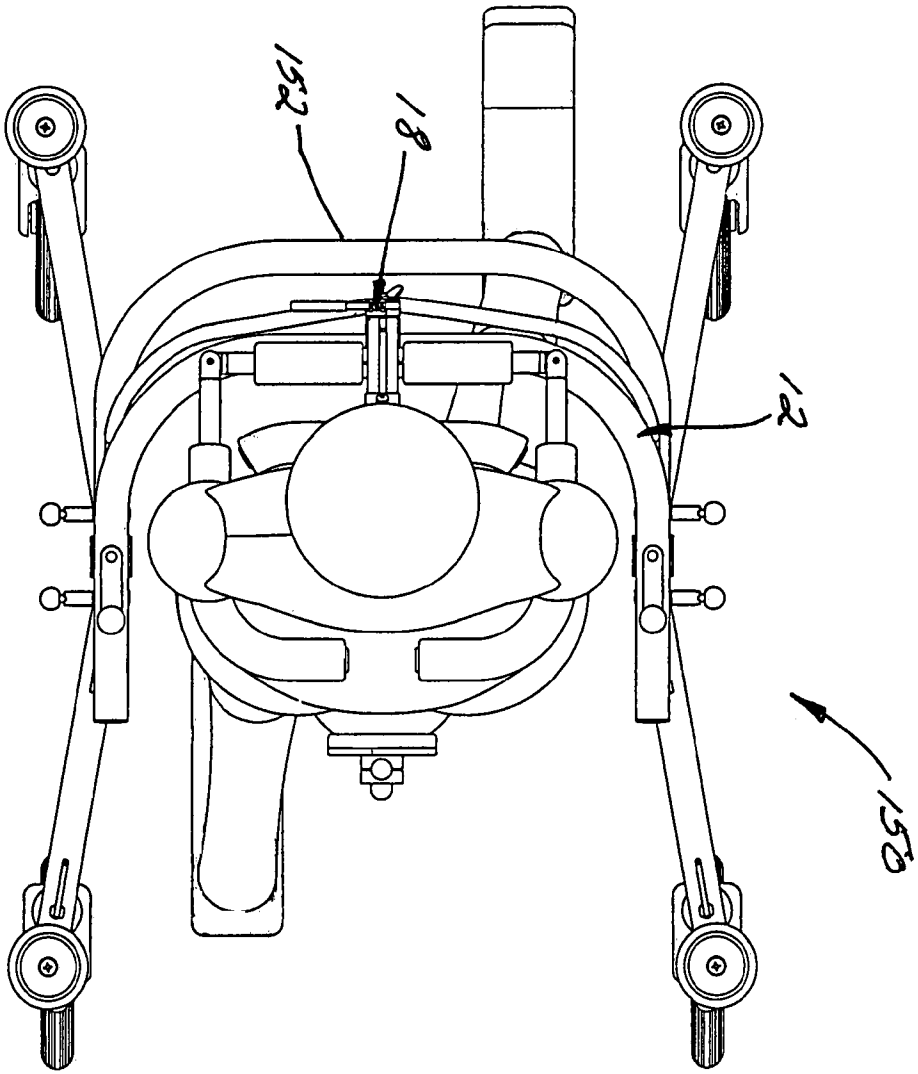
FIG. 23 is a top plan view of FIG. 20.

Turning lastly to FIGS. 17, 18 and 19, the structure and function of the body weight support members 14*a* (and 14*b*) are there shown and represents a preferred aspect of this invention. Each of these body weight supports 14*a* includes an upper tubular member 24*a* which is rigidly connected as by weldment to the arcuate tubular member 20 of the main frame 12. A lower tubular member 28*a* is slidably engageable in close mating overlapping telescoping alignment with respect to the upper tubular member 24*a*. Positioned within the upper and lower tubular members 24*a* and 28*a*, respectively, is an elongated height adjustment block 122 which receives an elongated axial adjustment screw 120 attached at an upper end to adjustment handle 100*a*. Disposed at the lower end of the height adjustment block 122 is an elongated compression spring 124 having a spring seat 126 positioned at the lower end thereof. An elongated gas spring 128 extends downwardly from a seating cavity in the lower surface of this spring seat 126, the spring seat 126 being held within opposing slide bearings 130 which are held within the lower tubular member 28*a*. These slide bearings 130 also prevent rotation of height adjustment block 122.

The elongated actuating shaft 132 of the gas spring 128 extends downwardly to a gas spring release head 134 which is held in position by transverse pin 142 within aligned apertures 140 formed into the lower tubular member 28*a* and 30*a*. This pin 142 in aperture 140 may be viewed as equivalent to being grounded on support surface W.

After the initial gross height of seat 62 is established in the direction of arrow B and the tubular member 66 is secured at that height by handle 65 as previously described in FIG. 3, the second mode of adjustment provided to the user is with respect to height adjustment handles 100*a* and 100*b* which are manually rotated by the user to cause the threaded height adjustment screw 120 in height adjustment block 122 to elevate or lower the main frame 12 in the direction of arrow A. In this mode of operation, the gas spring 128 and the compression spring may be viewed as substantially non-compressible. This adjustment facilitates fine incremental movements of the seat 62 up and down to more precisely suit the comfort level and height needs of the user.

Figure 7:
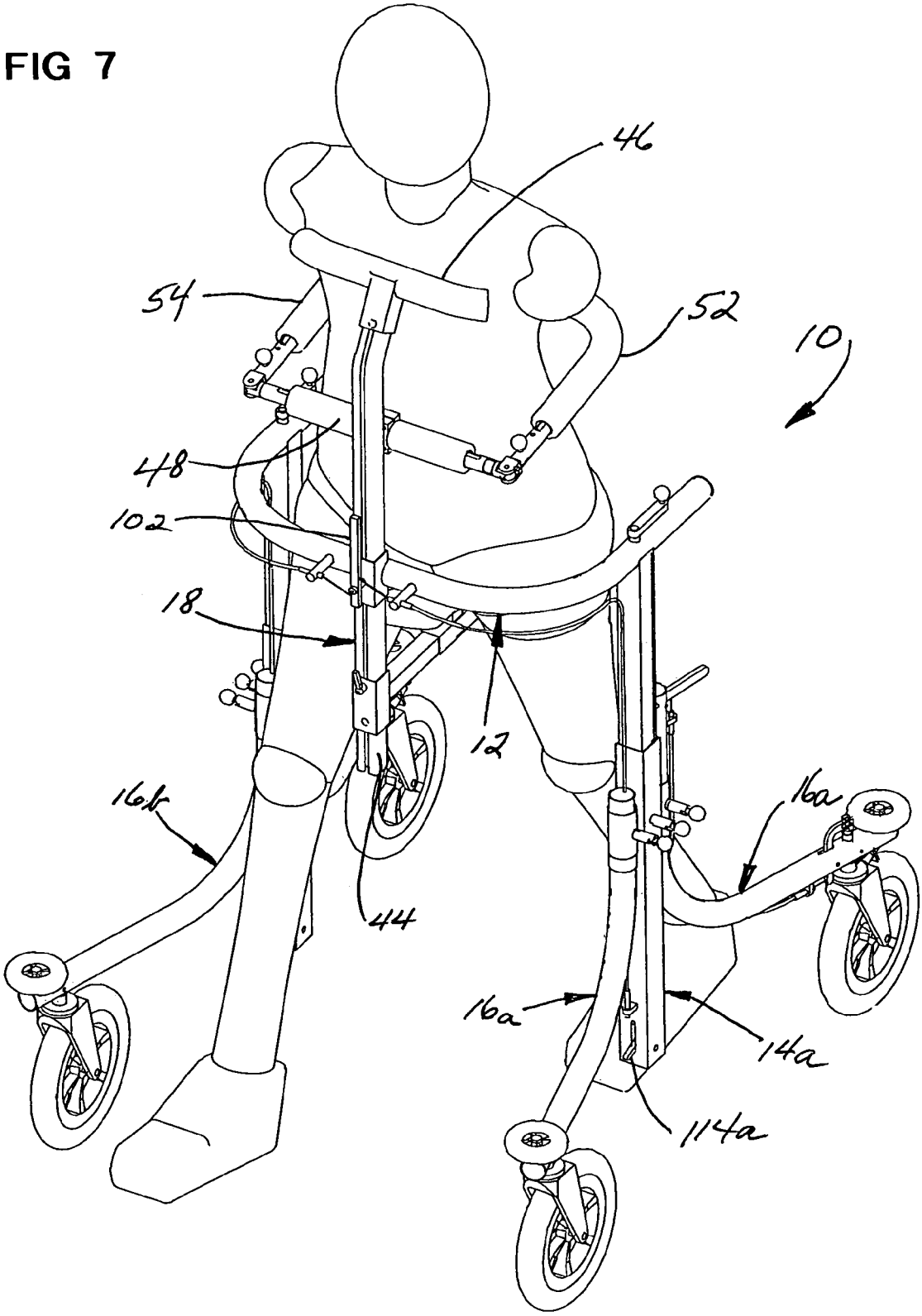
FIG. 7 is a front perspective view of the invention depicting a humanoid supported thereby during a normal walking gait.
Figure 8:
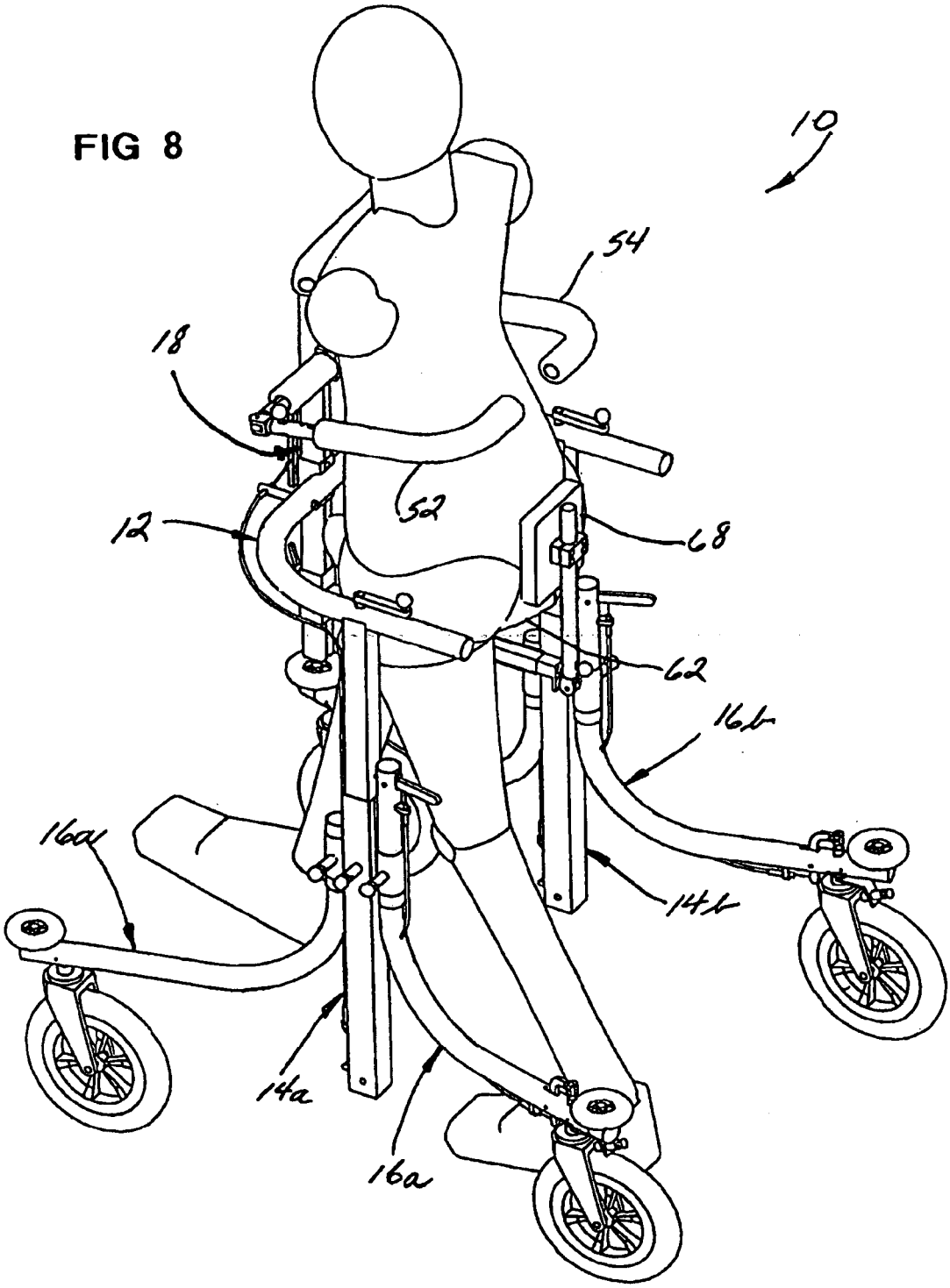
FIG. 8 is a rear perspective view of FIG. 7.

During each stride taken within the walking gait of the user, the height of the perineal area and pelvis of the user rises and falls a distance K in FIG. 17, the lowest point of the perineal area of the user being at the end point of each stride as seen in FIGS. 7, 8 and 9. At the mid-point in the stride (not shown) when the legs are adjacent one to another, the height of the perineal area is at its maximum height above the support surface W. With the seat 62 properly adjusted height wise, the user will receive upwardly body support from the compression of spring 124 which is selected to have a compression spring rate such that a movement of 1" in the perineal area and pelvis of the user downwardly will product an upward supportive force in the range of about 80–170 pounds.

Entrance and Egress

As previously described, the coccyx support 68 is pivotally downwardly movable in the direction of arrow F in FIG. 9. This places the coccyx support 68 in the general height range of seat 62. However, to further facilitate entrance and egress, the seat 62, along with the main frame 12, may be lowered a significantly larger distance L in FIG. 17. This is accomplished by moving lever 114*a* (and 114*b*) which extends through slot 138*a* in FIG. 17, upwardly in the direction of arrow M in FIG. 19 about its pivot point 136. This pivotal movement in the direction of arrow M is facilitated by the rotational movement of lever 102 laterally which actuates the inner cores 105*a* and 105*b* of cables 104*a* and 104*b*, supported in mounting blocks 144*a*, upwardly in the direction of arrow P.

This pivotal movement of arm 114*a* and 114*b* causes the corresponding nipple 150 to be depressed into the actuator rod 132 of the gas spring 128. At this point, the gas spring is in the "released" position whereupon the actuator rod 132 is biased to extend fully from the body of the gas spring 128. However, applying body weight to the seat 62 will cause the gas spring 128 to completely compress in the direction of arrow L in FIG. 17 to a fully retracted or shortened position whereupon release of the nipple 150 will again lock the air spring 128 and maintain that retracted orientation.

Upon entrance to the device 10, the user will simply position himself above the seat 62 in this fully lowered position and again pivot the handle 102 to cause the gas spring 128 to move into the "released" mode whereupon the actuator rod 132 will fully extend in the direction of arrow J and raise the seat back to the preadjusted in-use position.

Balancing Vertical Displacement

Referring now to FIGS. 20 to 23, in certain circumstances of unbalanced vertical weight placed on opposite sides of the main frame 12, it has been found that the relative displacement between the upper tubular members 24/26 in the corresponding lower tubular members 28/30, (previously described at A), in certain circumstances may not be equal. This condition occurs responsive to leaning of the user to the right or left or otherwise applying unequal downward pressure to each side of the main frame 12.

To correct this condition and to cause the main frame 12 to displace uniformly downwardly or upwardly on each side thereof, the embodiment 150 again shown in FIGS. 20 to 23, is provided. This embodiment 150 (now preferred) is substantially as previously described with the exception of the addition of the transverse connecting crossmember 152 which, as shown, is arcuately configured to extend forwardly of the center post 18, arching rearwardly for rigid interconnection of each end thereof to each of the corresponding lower tubular members 28 and 30. This crossmember 152 thus causes the relative displacement A of the upper tubular members 24 and 26 within the corresponding lower tubular members 28 and 30, respectively, to be substantially equal to one another regardless of the weight imbalance applied to the main frame 12.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. An assistive walking device for a user having postural control defects and/or insufficient leg strength to stand or walk independently, said device comprising:

a U-shaped generally horizontally disposed main frame having a forwardly disposed mid-portion and spaced rearwardly disposed hand gripping supportive end portions;

two spaced elongated upright body weight support members each attached at an upper end thereof to said main frame between the mid-portion and a respective end portion;

two pairs of elongated leg members, each said pair of leg members connected to one of said body support members with one said leg member of each said pair extending forwardly, and the other said leg member of each said pair extending rearwardly, of the corresponding said body support member, each of said leg members including a rollable member attached to a distal end portion thereof;

an elongated upright centerpost attached to and supported on said main frame at the mid portion of the main frame;

an elongated seat attached to and supported on a lower portion of said centerpost, said seat extending longitudinally along a center of said device;

two spaced opposing rearwardly opening lateral torso supports attached to, supported on, and extending rearwardly of said centerpost, said torso supports positioned above said main frame at a height above a support surface for said device which positions an anterior thoracic area of the user in device-propelling contact therewith during a walking gait, said seat being positionable between the legs of the user at a height above the support surface in close supportive proximity to a perennial region of the user;

a transversely extending displacement equalizing crossmember rigidly connected at each end thereof and extending between a lower portion of each of said body weight support members whereby each of said body weight support members are variable in length a substantially equal amount responsive to user weight applied to the upper ends thereof through said seat during each stride taken during the walking gait or responsive to body weight against the main frame;

said main frame opening rearwardly of said device whereby the user enters and leaves said device from rearwardly thereof.

2. An assistive walking device as set forth in claim 1, wherein:

said seat has a top surface which is arcuately concaved centrally and arcuately narrowing central side surfaces defining enlarged end portions of said seat whereby the walking gait is facilitated while providing a variable body weight support.

3. An assistive walking device as set forth in claim 1, further comprising:

an elongated sternum support connected to and transversely extending across said centerpost and positioned above said torso supports for contact with the sternum of the user to assist in hands-free propelling of said device.

4. An assistive walking device as set forth in claim 1, further comprising:

a coccyx support attached to said seat and positioned behind said seat to assist in rearward hands-free propulsion of said device.

5. An assistive walking device as set forth in claim 1, wherein each of said body weight support members further include:

a collapsible member for selectively further reducing the length of said body support member and the height of said seat to facilitate entrance and egress from said device.

6. An assistive walking device as set forth in claim 1, wherein:

each of said body weight support members includes:

an elongated compression spring and a gas spring acting in series between said leg members and said main frame;

said compression spring providing user body weight support applied against said seat during the walking gait;

said gas spring having a locked and released mode, said locked mode maintaining a preselected length of said gas spring, said released mode allowing said gas spring to be shortened or varied in length by user body weight applied atop said seat and, thereafter, to be returned to said locked load whereby entrance to and egress from said device is facilitated.

7. An assistive walking device as set forth in claim 1, wherein:

said leg members are releasable and pivotable about an upright axis positioned parallel to and along side of the corresponding said body weight support member whereby said leg members are foldable together in overlapping fashion between said body weight support members.

8. An assistive walking device for a user having postural control defects and/or insufficient leg strength to stand or walk independently, said device comprising:

a main frame having a forwardly disposed mid-portion thereof;

two spaced elongated upright body weight support members each attached at an upper end thereof to a different side portion of said main frame whereby a user may be positioned therebetween;

two elongated leg members connected to each of said body support members, one of said leg members extending forwardly and the other said leg member extending rearwardly of the corresponding said body support member, each of said leg members including a rollable member attached to a distal end portion of the main frame;

an elongated upright centerpost attached to and supported on said main frame at the mid portion thereof;

an elongated seat attached to and supported on a lower portion of said centerpost, said seat extending longitudinally along a center of said device said seat being positionable between the legs of the user at a height above a support surface in close supportive proximity to a perineal region of the user in a standing position;

two spaced opposing rearwardly opening torso supports attached to, supported on, and extending rearwardly of said centerpost, said torso supports positioned above said main frame at a height which positions an anterior thoracic area of the user in device-propelling contact therewith during a walking gait;

a transversely extending displacement equalizing cross-member rigidly connected at each end thereof and extending between a lower portion of each of said body weight support members whereby each of said body weight support members are resiliently reducible in length a substantially equal amount responsive to user weight applied to the upper ends thereof by user body weight being applied to said seat during each stride taken in the walking gait or said main frame;

said main frame opening rearwardly of said device whereby the user enters and leaves said device from rearwardly thereof.

9. An assistive walking device as set forth in claim 8, wherein:

said seat has a top surface which is arcuately concaved centrally and arcuately narrowing central side surfaces defining enlarged end portions of said seat whereby the walking gait is facilitated while providing a variable body weight support.

10. An assistive walking device as set forth in claim 8, further comprising:

an elongated sternum support connected to and transversely extending across said centerpost and positioned above said torso supports for contact with the sternum of the user to assist in hands-free propelling of said device.

11. An assistive walking device as set forth in claim 8, further comprising:

a coccyx support attached to said seat and positioned behind said seat to assist in rearward hands-free propulsion of said device.

12. An assistive walking device as set forth in claim 8, wherein each of said body weight support members further include:

a collapsible member for selectively further reducing the length of said body support member and the height of said seat to facilitate entrance and egress from said device.

13. An assistive walking device as set forth in claim 8, wherein:

each of said body weight support members includes:

an elongated compression spring and a gas spring acting in series between said leg members and said main frame;

said compression spring providing user body weight support applied against said seat during the walking gait;

said gas spring having a locked and released mode, said locked mode maintaining a preselected length of said gas spring, said released mode allowing said gas spring to be shortened or varied in length by user body weight applied atop said seat and, thereafter, to be returned to said locked load whereby entrance to and egress from said device is facilitated.

14. An assistive walking device as set forth in claim 8, wherein:

said leg members are releasable and pivotable about an upright axis positioned parallel to and along side of the corresponding said body weight support member whereby said leg members are foldable together in overlapping fashion between said body weight support members.

15. An assistive walking device for a user having postural control defects and/or insufficient leg strength to stand or walk independently, said device comprising:

a main frame having a forwardly disposed mid-portion thereof;

two spaced elongated upright body weight support members each attached at an upper end thereof to one of two side portions of said main frame whereby a user may be positioned between said body support members;

two elongated leg members connected to each of said body support members, one of said leg members extending forwardly and the other said leg member extending rearwardly of the corresponding said body support member, each of said leg members including a rollable member attached to a distal end portion thereof;

an elongated upright centerpost attached to and supported on said main frame at the mid portion of the main frame;

an elongated perineal, ischial tuberosity support attached to and supported on a lower portion of said centerpost and extending longitudinally along a center of said device, and further, being positionable between the legs of the user at a height above a support surface in close supportive proximity to a perineal region of the user;

two spaced opposing rearwardly opening mid-thoracic support arms attached to, supported on, and extending rearwardly of said centerpost, said support arms positionable at a height above a support surface such that an anterior thoracic area of the user is positioned in hands-free device-propelling contact therewith during a walking gait;

a transversely extending displacement equalizing cross-member rigidly connected at each end thereof and extending between a lower portion of each of said body weight support members whereby said body weight support members are resiliently reducible in length in substantially equal amounts responsive to user weight applied to the upper ends thereof by user body weight so as to maintain said main frame in a substantially level orientation to the support surface;

said main frame opening rearwardly of said device whereby the user enters and leaves said device from rearwardly thereof.

16. An assistive walking device as set forth in claim 15, wherein:

said seat has a top surface which is arcuately concaved centrally and arcuately narrowing central side surfaces defining enlarged end portions of said seat whereby the walking gait is facilitated while providing a variable body weight support.

17. An assistive walking device as set forth in claim 15, further comprising:

an elongated sternum support connected to and transversely extending across said centerpost and positioned above said torso supports for contact with the sternum of the user to assist in hands-free propelling of said device.

18. An assistive walking device as set forth in claim 15, further comprising:

a coccyx support attached to said seat and positioned behind said seat to assist in rearward hands-free propulsion of said device.

19. An assistive walking device as set forth in claim 15, wherein each of said body weight support members further include:

a collapsible member for selectively further reducing the length of said body support member and the height of said seat to facilitate entrance and egress from said device.

20. An assistive walking device as set forth in claim 15, wherein:

each of said body weight support members includes:

an elongated compression spring and a gas spring acting in series between said leg members and said main frame;

said compression spring providing user body weight support applied against said seat during the walking gait;

said gas spring having a locked and released mode, said locked mode maintaining a preselected length of said gas spring, said released mode allowing said gas spring to be shortened or varied in length by user body weight applied atop said seat and, thereafter, to be returned to said locked load whereby entrance to and egress from said device is facilitated.

21. An assistive walking device as set forth in claim 15, wherein:

said leg members are releasable and pivotable about an upright axis positioned parallel to and along side of the corresponding said body weight support member whereby said leg members are foldable together in overlapping fashion between said body weight support members.

* * * * *